US005743526A

United States Patent [19]

Inoue

[11] Patent Number: 5,743,526

[45] Date of Patent: Apr. 28, 1998

[54] BINGO GAME MACHINE

[75] Inventor: Haruo Inoue, Tokyo, Japan

[73] Assignee: Eagle Co. Ltd., Tokyo, Japan

[21] Appl. No.: 771,997

[22] Filed: Dec. 23, 1996

[30] Foreign Application Priority Data

| | | | |
|---|---|---|---|
| Sep. 9, 1996 | [JP] | Japan | 8-261329 |
| Sep. 10, 1996 | [JP] | Japan | 8-262462 |
| Oct. 17, 1996 | [JP] | Japan | 8-297204 |

[51] Int. Cl.[6] ..... A63F 3/06; A63F 9/00

[52] U.S. Cl. ..... 273/144 R; 273/144 B

[58] Field of Search ..... 273/144 R, 144 A, 273/144 B, 145 C, 145 CA

[56] References Cited

U.S. PATENT DOCUMENTS

| | | | |
|---|---|---|---|
| 4,508,346 | 4/1985 | Salvucci | 273/144 B |
| 4,583,736 | 4/1986 | Lorraine | 273/144 B |
| 4,786,056 | 11/1988 | Dunnigan | 273/144 A |
| 4,861,032 | 8/1989 | Gaylor | 273/144 B |
| 4,892,310 | 1/1990 | Patterson | 273/144 A |
| 4,961,578 | 10/1990 | Chateau | 273/144 R |

*Primary Examiner*—Benjamin H. Layno

*Attorney, Agent, or Firm*—Edwin E. Greigg; Ronald E. Greigg

[57] ABSTRACT

A bingo game machine which can carry out a series of operations including storing discrimination balls which are to be blown by an air blower into a closed vessel. The balls are blown about within the vessel with some balls falling onto a return surface to the storage area and some falling into a storage member. The balls falling into the storage member are detected and are the balls used to determine the winning balls for the bingo game. Once the balls have been received and detected, the game is over and the balls in the storage member are dropped into the storage area for the next game. A motor drives a screw rod in order to open a bottom of the storage member in order to release the balls that have fallen into the storage member. The motor moves the bottom back into place to close the bottom for the next game.

22 Claims, 25 Drawing Sheets

BINGO GAME MACHINE

BACKGROUND OF THE INVENTION

This invention relates to a bingo game machine. Particularly, this invention relates to a bingo game machine of which a vessel (housing) is of the fixed type.

Hitherto, an example of the bingo game machine of this kind is described in the Japanese Patent Publication No. 28947/1995.

The fundamental configuration of this example comprises a base of the game machine including blower therewithin, and a transparent vessel fixedly attached at an opening portion of the upper wall of the base and adapted so that plural discrimination balls are accommodated therewithin. When the discrimination balls are caused to float by air flow based on the blower of the base side, they are mixed within the vessel. Then, several floating discrimination balls are discharged (taken out) from the ball outlet hole of the vessel to the outside of the vessel.

However, in the above-mentioned configuration, there were drawbacks as recited below.

a) The discrimination balls discharged from the vessel must be contained into the vessel every respective game. Accordingly, labor is required, and the inner wall surface of the transparent vessel becomes soiled through soil of the discrimination balls.

b) Since air sent into the vessel through the duct from the blower is discharged toward the external end of the vessel, air within the room is agitated (mixed). For this reason, troublesome problem exist.

SUMMARY OF THE INVENTION

This invention has been made in view of drawbacks with the prior art as described above, and a first object of this invention is to provide a bingo game machine which can automatically and immediately carry out a series of operations of elevation (rising), detection, storage (accumulation) and discharge (ejection), etc. of discrimination balls within the vessel. Thus, the inner wall surface of the vessel and/or the discrimination balls are prevented from being soiled by dust within the room.

A second object of this invention is to have an ability of elevating (raising) plural discrimination balls along the inner wall of the vessel, or blowing them therearong. In this case, the discrimination balls can be flown up one after another, or can be elevated with good balance at a stroke.

A third object of this invention is to have an ability of discharging, into the vessel, at a stroke, discrimination balls within the ball storage member disposed within the vessel at the time when one game is completed.

The configurations of respective embodiments of this invention of which objects are the same are as follows.

(1) A bingo game machine comprises a base, a spherical vessel attached on the upper wall of the base, plural discrimination balls accommodated within the vessel, elevating means for elevating these discrimination balls, means for catching (receiving) the elevated discrimination balls to detect them, a ball storage member for storing the discrimination balls discriminated by the detecting means into a ball storage portion, and a ball discharge unit provided with, in a longitudinal direction thereof, a working (operation) rod member having an opening/closing cover for opening a lower end opening of the ball storage member, thus to continuously carry out elevation, detection, storage and discharge of the discrimination balls within the vessel.

(2) A bingo game machine comprises a box-shaped base, a transparent vessel attached on the upper wall of the base, a ball storage member fixedly disposed within the vessel and adapted for storing several discrimination balls discriminated by detecting means, and a discrimination ball discharge unit having an opening/closing cover for opening or closing the lower portion of the ball storage member, wherein a blower is disposed within the base, and a blast guide member is interposed between a discharge hole of the blower and a blast hole at the lower portion of the vessel, whereby air blown out from the blast hole into the vessel returns into the base through an opening portion at the lower portion of the vessel and cyclically flows into an air suction hole of the blower.

(3) A bingo game machine comprises a base, a spherical vessel attached on the upper wall of the base, plural discrimination balls accommodated within the vessel, a hollow fixed shaft provided in a longitudinal direction at a supporting frame fixedly attached within the base, a ball flying unit adapted for clamping plural discrimination balls by a drive disk and a driven disk which are rotatably provided on the fixed shaft and adapted for releasing a clamped state by the both disks to thereby fly the discrimination balls along the inner wall of the vessel, a ball storage member fixedly disposed within the vessel so as to have an ability of detecting, through detecting means, the discrimination balls elevated by the ball flying unit and adapted for storing the detected discrimination balls into a ball storage portion, and a ball discharge unit in which a working (operation) rod member is provided within the fixed shaft and it has an opening/closing cover for opening/closing the lower portion of the ball storage member at the upper end portion of the working rod member.

BRIEF DESCRIPTION OF THE DRAWINGS

FIG. 1 is taken as a reference.

FIG. 14 is taken as a reference.

DESCRIPTION OF THE PREFERRED EMBODIMENTS

Figure 1:
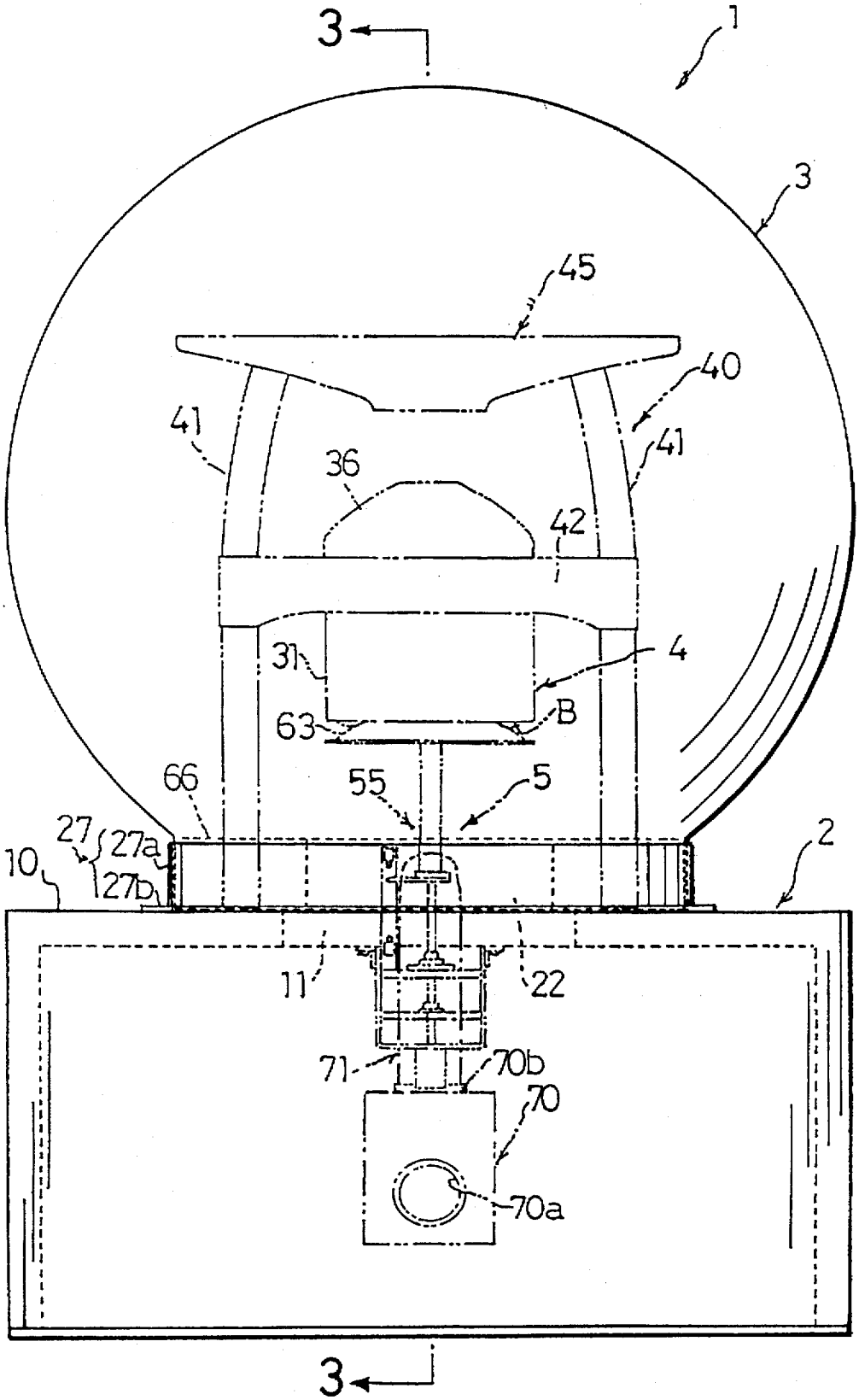
FIG. 1 is an explanatory view showing an outline of the entire appearance configuration of a first embodiment.

Preferred embodiments of this invention will now be described with reference to attached drawings.

FIGS. 1 to 11 are views showing a first embodiment of a bingo game machine according to this invention.

Reference numeral 1 denotes the bingo game machine of the first embodiment. This bingo game machine 1 comprises a box-shaped base 2, a transparent vessel 3 fixedly or detachably attached on the upper wall of the base 2, a ball storage member 4 fixed at the inside of the vessel 3 and having a tubular ball storage portion for storing several discrimination balls discriminated by detecting means, and a discrimination ball discharge unit 5 having an opening/closing cover for opening or closing the lower portion of the ball storage member 4, wherein an air blower 70 is disposed within the base 2 and an air blast guide member 71 is caused to be interposed between the discharge hole (port) of the blower 70 and an air blast (blowing) hole at the lower portion of the vessel, whereby air blown out into the vessel from the air blast hole returns into the base 2 through an opening portion or suction guide member for circulation at the lower portion of the vessel and cyclically flows into an air suction hole 70*a* of the blower 70.

Figure 7:
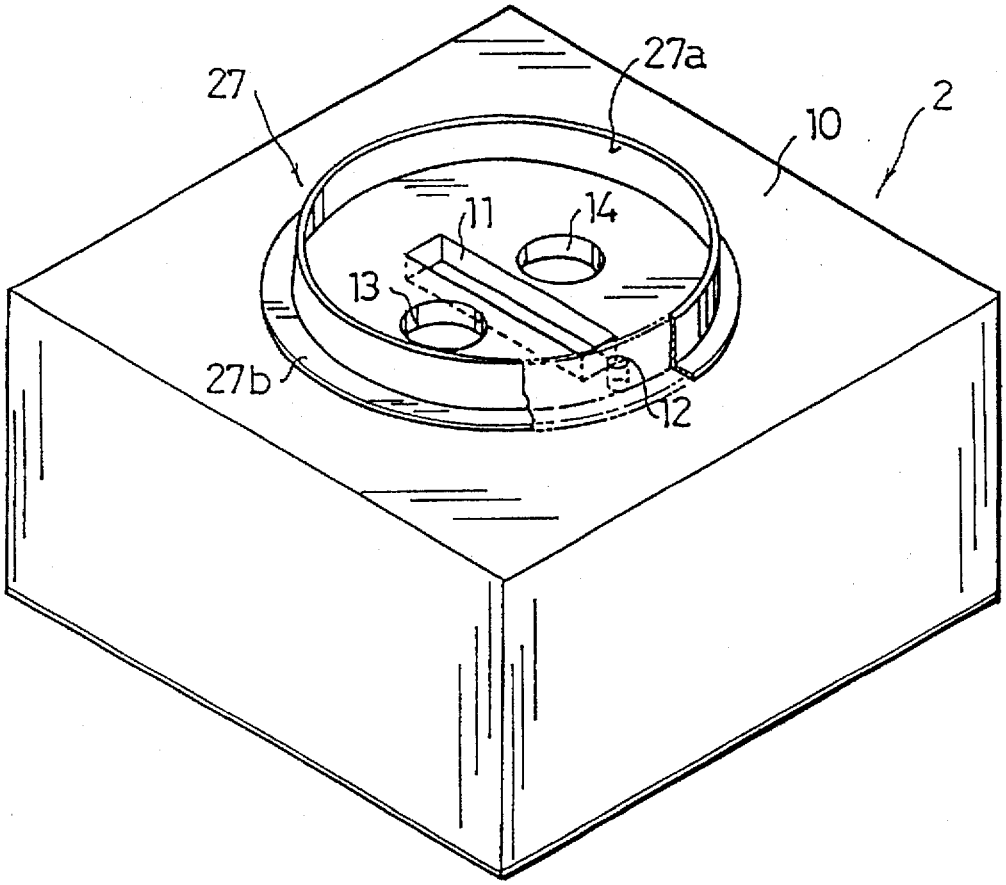
FIG. 7 is a perspective view of the essential part (base) of the first embodiment.

These fundamental constituent members will be described in order as below. Initially speaking, the base 2 has a shape of box having a bottom. As shown in FIG. 7, a rectangular opening portion 11 is formed at the central portion of upper wall 10 of the base 2. Moreover, a penetration hole 12 for a wiring cord is formed at the portion close to the opening portion 11 of the upper wall 10. Further, at the portion close to the opening portion 11 of the upper wall, there is formed a penetration hole 13 for a blast guide member adapted so that the upper end portion of the air blast guide member 71 is penetrated therethrough, and communicating with blast (blowing) hole (blowoff hole) 23 shown in FIG. 8.

Moreover, at the opposite side (right side in FIG. 3) of the penetration hole 13 for the blast (blowing) guide member, a penetration hole (suction hole) 14 for the return blast (wind or air) guide member or return blast (wind or air) is formed. It is to be noted that it is desirable that the base 2 should be of the sealing type except for the opening portion or the penetration hole.

The vessel 3 will now be described. The vessel 3 is spherical as a whole, and is transparent or semi-transparent. As this vessel 3, a vessel in which halved semi-circular bodies are combined, or a vessel of the unitary molded type may be employed.

Figure 8:
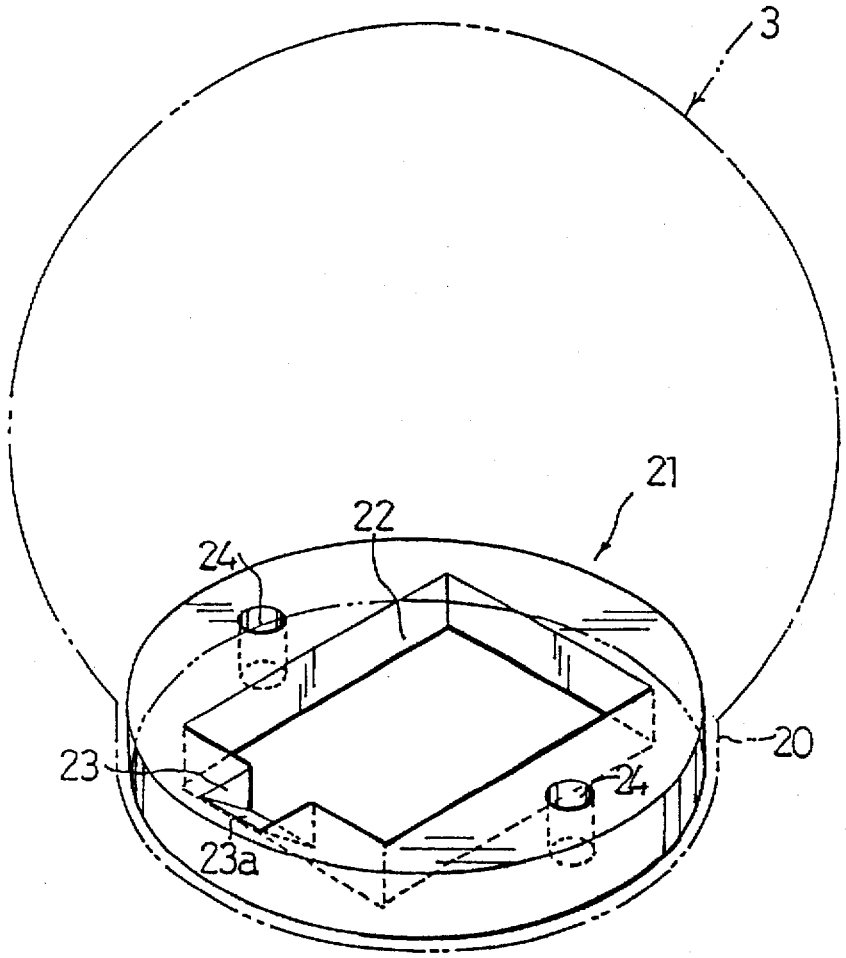
FIG. 8 is a perspective view of the essential part (vessel) of the first embodiment.

Further, a circumferential wall 20 projected in a lower direction is formed at the lower portion of the vessel 3, and a ring-shaped attachment base plate 21 is fixedly provided within the circumferential wall 20. The attachment base plate 21 includes a central hole 22 having a relatively large diameter as shown in FIG. 8. This central hole 22 communicates with at least the penetration hole 14 for the return blast guide member or return blast. In this case, when FIG. 8 is taken as a reference, a blast (blowing) hole (blow-off hole) 23 in cut form communicating with the central hole 22 is formed in the radial direction at the left side. Further, one surface 23*a* of inner wall surfaces forming the air blast (blowing) hole 23 is formed oblique in consideration of direction of wind (air) blown out into the vessel. In addition, plural attachment holes 24 for supporting the member which directly or indirectly supports the ball storage member 4 are formed at the attachment base plate 21.

Meanwhile, various methods for attaching the vessel 3 with respect to the base 2 are conceivable. In this embodiment, as shown in FIG. 7, there is used a ring-shaped fixing member 27 composed of a circumferential wall portion 27*a* into which the lower portion of the vessel 3 is detachably fitted and a circumferential collar (flange) portion 27*b* fixed on the upper surface of the upper wall 10 of the base 2.

Figure 4:
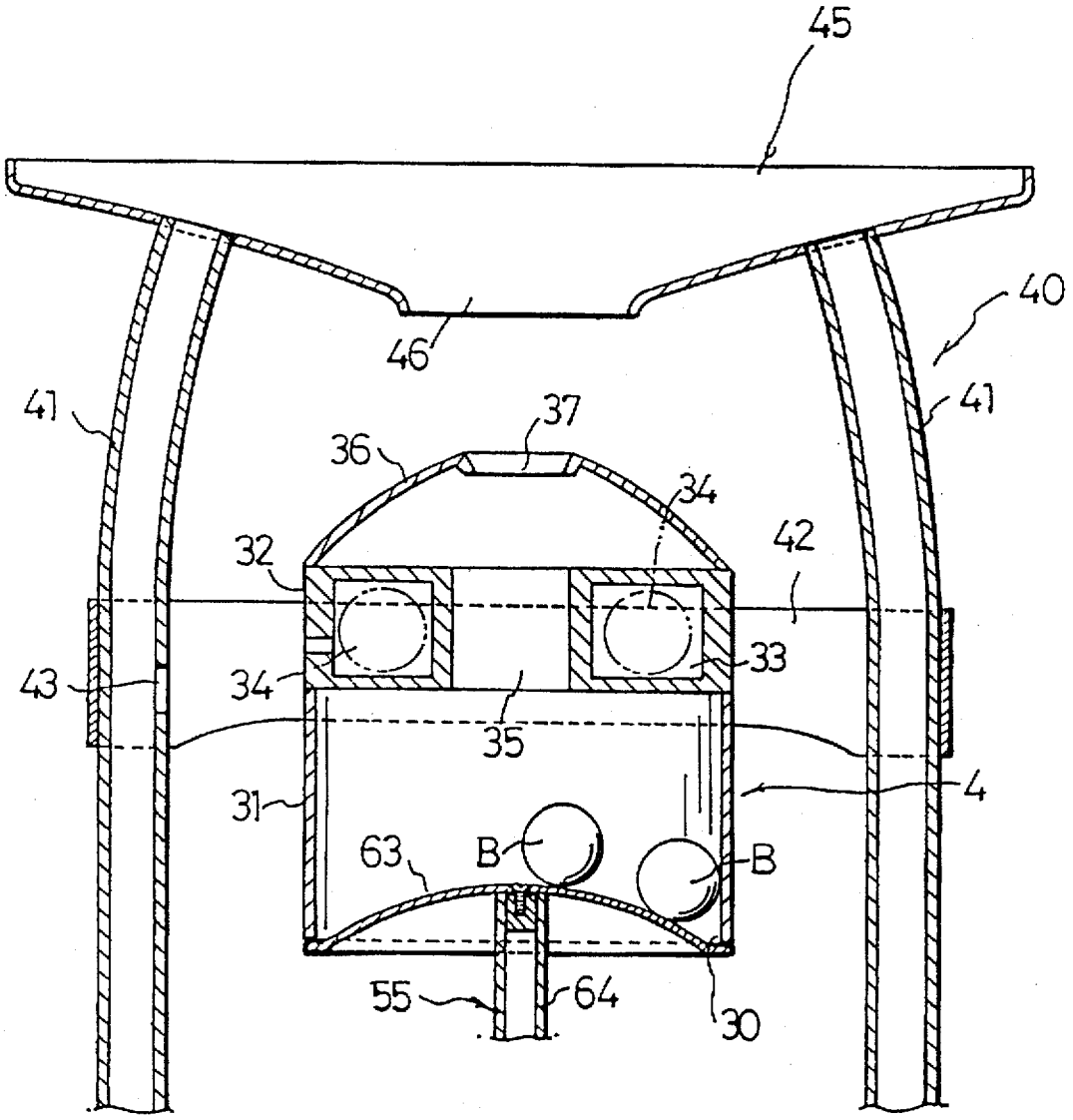
FIG. 4 is an explanatory view of the essential part (ball storage member) of the first embodiment.
Figure 5:
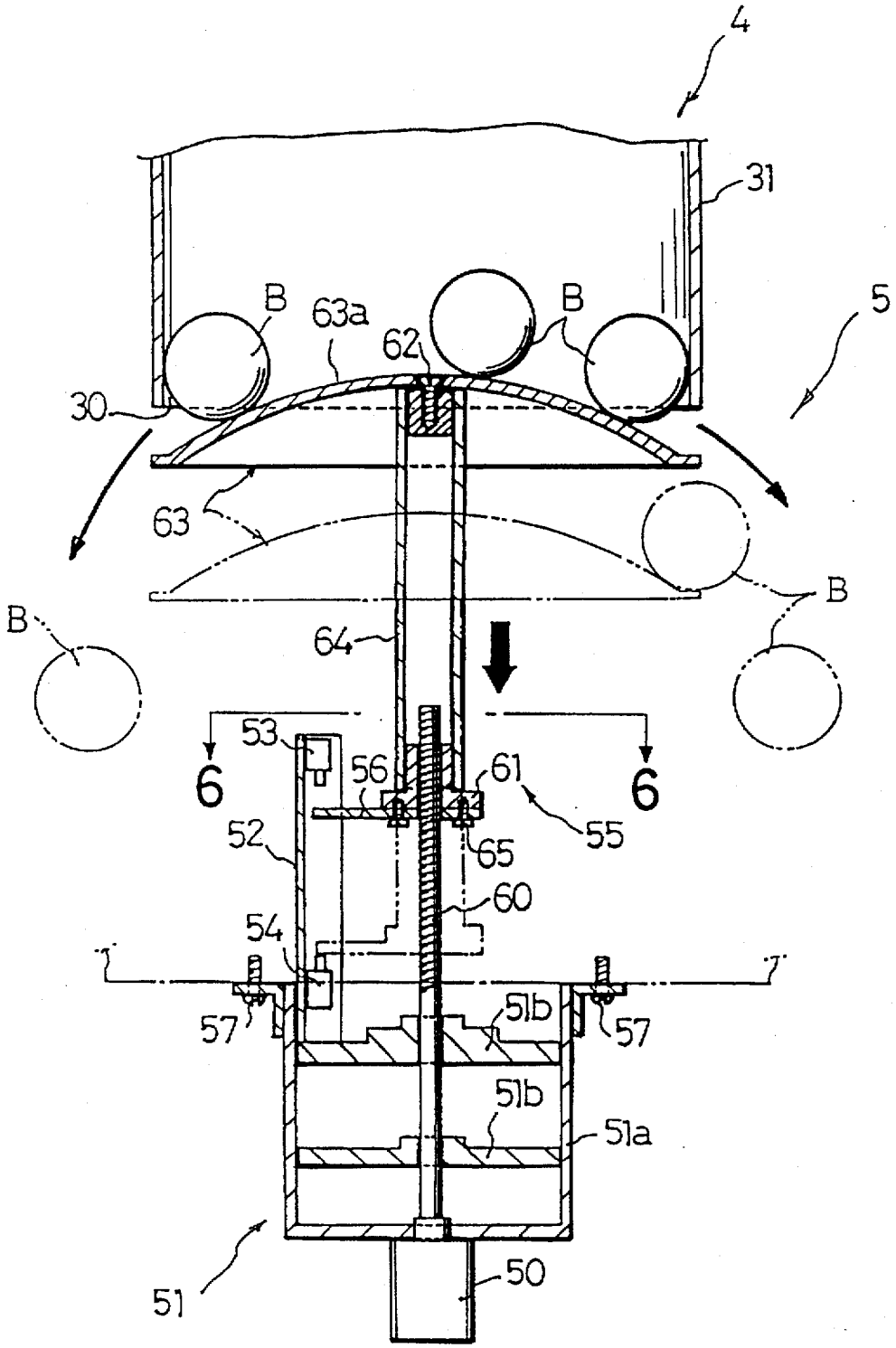
FIG. 5 is an explanatory view of the essential part (discrimination ball discharge unit) of the first embodiment.

The ball storage member 4 will now be described. As shown in FIGS. 4 and 5, the ball storage member takes a small box shape and includes an opening 30 at the lower end thereof. Further, reference 31 denotes a tubular ball storage portion. Reference numeral 32 denotes a doughnut shaped detecting portion continuously formed at the upper portion of the tubular ball storage portion 31. The inside of the doughnut shaped detecting portion 32 is constituted as an annular chamber 33. In addition, one detecting means 34, or two or more detecting means 34 is or are provided (accommodated) within the annular chamber 33 of the detecting portion 32. The detecting means 34 itself is well known (e.g., described in the Japanese patent Application Laid Open No. 92370/1988), and serves to discriminate discrimination ball B passing through, e.g., a passing (passage) hole 35 formed at the central portion of the detecting portion 32 to send a detection signal obtained as the result of discrimination to a Central Processing Unit (CPU) through a wiring cord (not shown). Reference numeral 36 denotes a cap hat-shaped in cross section which is fixedly provided at the upper portion of the detecting portion 32. This cap 36 is transparent or semi-transparent. At the central portion thereof, a catching (receiving) hole 37 for permitting falling (dropping) discrimination ball B to be passed therethrough is formed at the central portion. The catching hole 37 having a ball catching (receiving) function is formed so that its diameter is smaller than that of the passing (passage) hole 35 so that the discrimination ball B is not easily inserted thereinto. In this embodiment, the catching (receiving) hole 37 receives (catches), every at least one discrimination ball, discrimination balls B which have been passed through a central hole 46 of a ball catching (receiving) dish 45.

It is to be noted that there may be employed a configuration from a viewpoint of design in which an opening/closing cover for opening or closing the catching (receiving) hole 37 is provided at a suitable portion of the ball storage member 4 to close the opening/closing cover every time one discrimination ball B is inserted into the catching (receiving) hole 37 so that continuous admission of discrimination balls is prevented, and to open the opening/closing cover after discrimination by the detecting means is completed so that succeeding discrimination balls are admitted (inserted) into the lower portion of the ball storage member 4. In addition, there may be employed a configuration in which the discrimination ball B which has been admitted (inserted) into the catching (receiving) hole 37 is caused to once stay in the vicinity of the detecting means so that reliable detection can be carried out.

The supporting member 40 of the ball storage member 4 will now be described. The ball storage member 4 is fixedly disposed at a portion slightly lower than the central portion of the vessel through the supporting member 40 is provided within the vessel.

Figure 2:
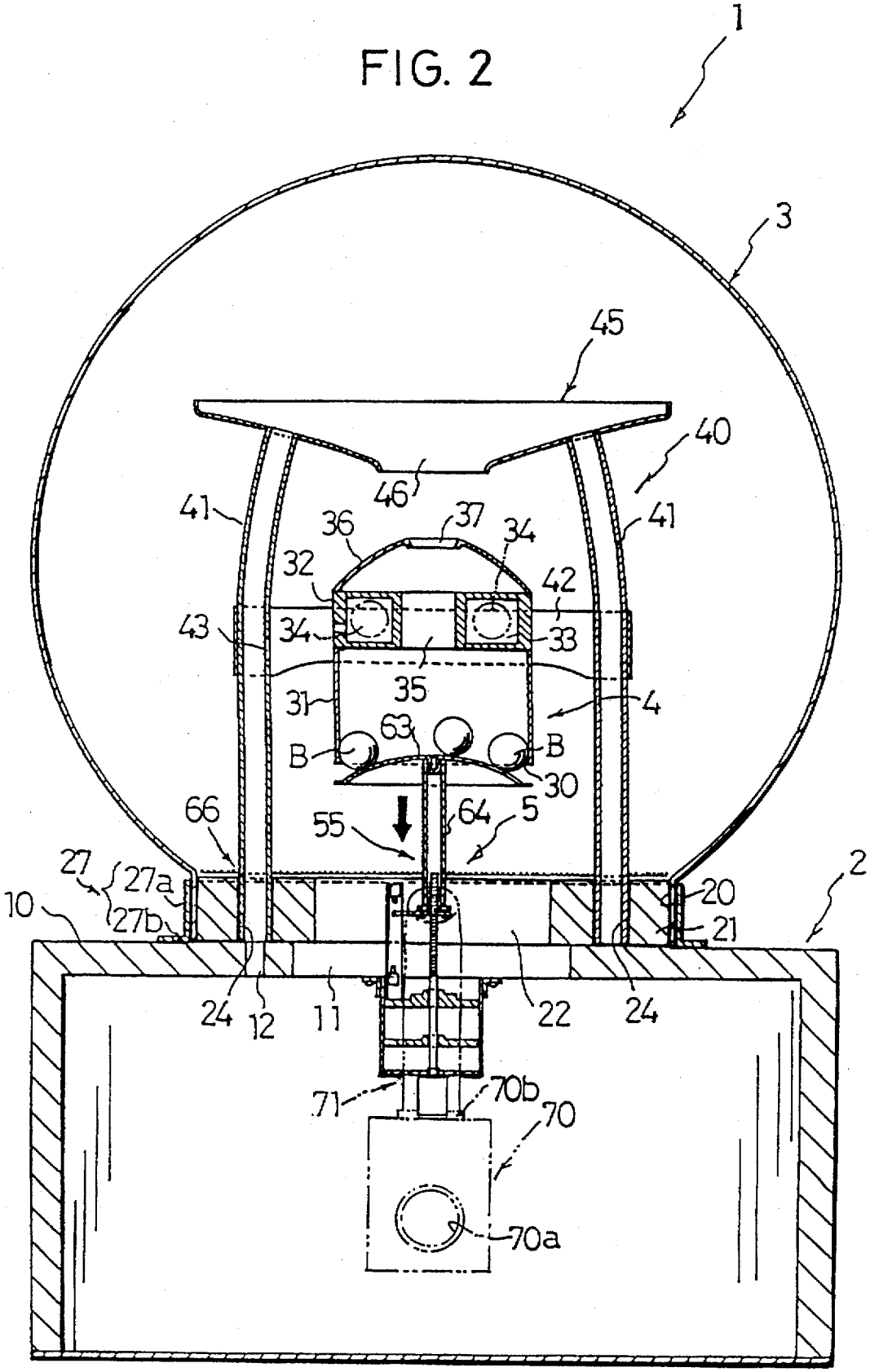
FIG. 2 is a schematic longitudinal cross sectional view when

The supporting member 40 is composed, in this embodiment, of two pipe-shaped supports 41, and a plate-shaped supporting arm 42. When FIG. 2 is taken as a reference, a pair of pipe-shaped supports 41 are opposed in left and right directions with a predetermined spacing (distance) therebetween, wherein the respective lower end portions are fixedly inserted into attachment holes 24 of the attachment base plate 21. Moreover, the upper end portions of the pair of pipe-shaped supports 41 are extended up to the portion close to the upper portion within the vessel, and are formed so that they are bent to some extent toward the inside. In this example, at one of the pipe-shaped supports 41, a small hole 43 for guiding a wiring code for the detecting means into the support is formed. While the plate-shaped supporting arm 42 may be provided at one pipe-shaped support 41 so as to grip the detecting portion 32 of the ball storage member 4 by one hand, it is fixedly laterally laid across the left and right pipe-shaped supports 41. Accordingly, the ball storage member 4 is disposed at the central portion between left and right pipe-shaped supports 41 through the plate-shaped supporting arm 42.

Figure 11:
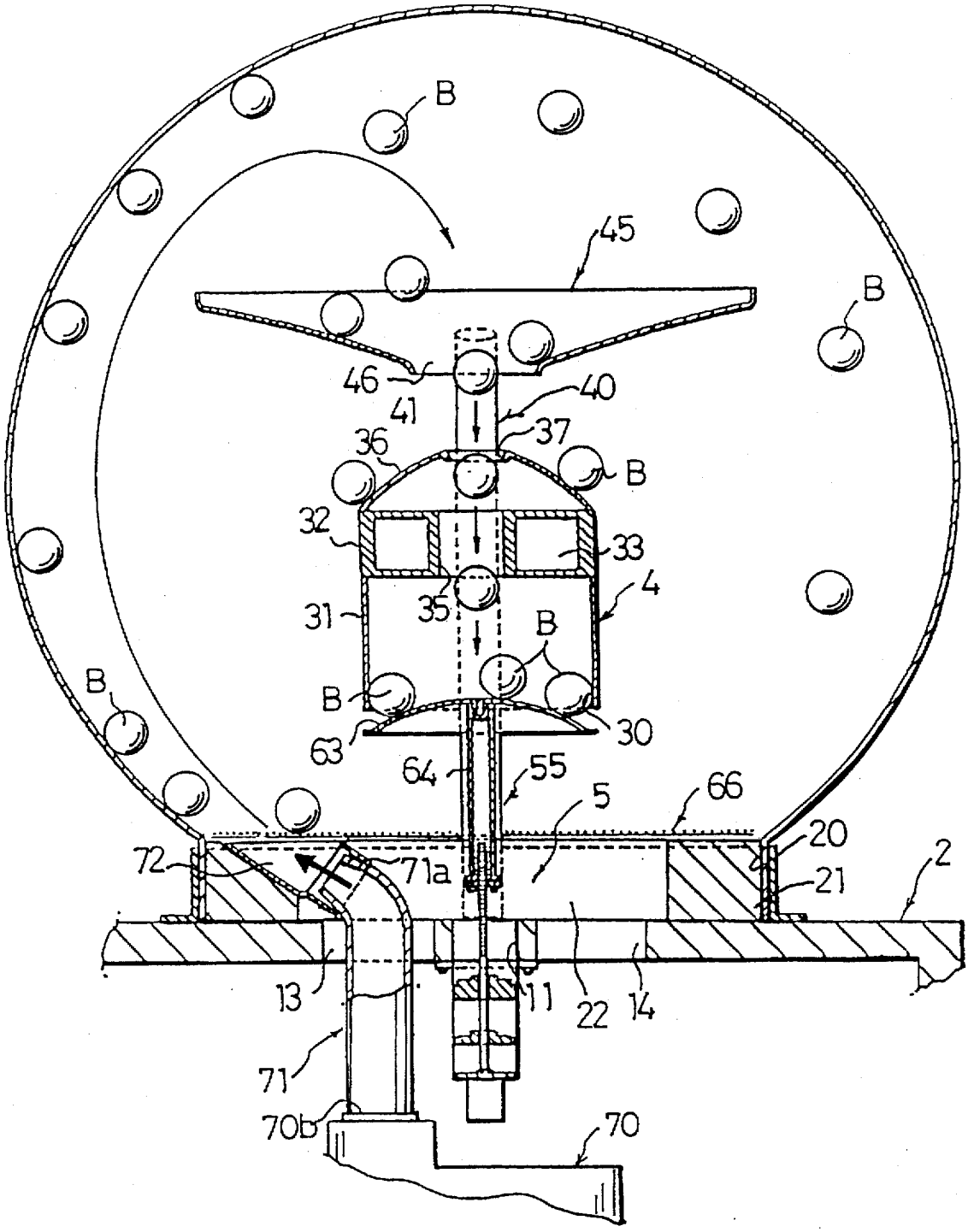
FIG. 11 is an explanatory view showing a further state of use (the relationship between discrimianton balls and ball storage member) of the first embodiment.

Meanwhile, as described above, reference numeral 45 denotes a ball catching (receiving) dish fixedly provided at the upper end portion of the pair of pipe-shaped supports 41. At the central portion of the ball catching (receiving) dish 45, center hole 46 having a diameter greater than that of the catching (receiving) hole 37 of the ball storage member 4 is formed. As shown in FIG. 11, this ball catching (receiving) dish 45 catches (receives) the discrimination balls B blown up in a manner along the inner wall of the vessel 3 to guide the discrimination balls B thus caught into the center hole 46. When the discrimination ball B caught by the ball catching dish 45 is passed through the center hole 46 with good timing, and falls into the ball storage member 4, it must be inserted in turn into the catching hole 37 of the ball storage member 4. It is to be noted that, from a viewpoint of design, the ball catching dish 45 may be adapted to allow the cap 36 itself of the ball storage member 4 to catch the discrimination ball B.

The discrimination ball discharge unit 5 will now be described. This discrimination ball discharge unit 5 FIG. 5 is essentially composed of an attachment member 51 provided with a drive source 50, plural position detecting sensors 53, 54 disposed in upper and lower directions through a vertical plate 52 at the attachment member 51, a working (operation) rod member 55 vertically moves by a drive force of the drive source 50, and a sensor contact plate 56 fixedly attached to the working (operation) rod member 55. The respective constituent members will now be described.

As an example of the drive source 50, a small-sized drive motor is employed. Although an air cylinder may be used as the drive source 50, a small-sized drive motor is desirable from a viewpoint of realization of lightness in weight of the unit.

The attachment member 51 is fixed on the lower surface of the upper wall 10 of the base through fixing means 57 so as to face the opening portion 11 of the base from the lower direction. Namely, the attachment member 51 is attached at the base 2 side. It is a matter of course that the attachment member 51 may be fixed on the attachment base plate 21 of the vessel 3 by a change of design. In short, it is sufficient to provide, in the vertical state, the working rod member 55 having the opening/closing cover for opening or closing, at a stroke, the lower portion of the ball storage member 4 within the lower portion of the vessel 3 (including the inside of the upper portion of the base 2 in this embodiment).

More particularly, as shown in FIG. 5, the attachment member 51 is composed of an external frame **51*a* channel-shaped in cross section, and plural horizontal pivotal plates 51*b* fixed within the external frame 51 with a predetermined spacing therebetween. The drive source 50 is fixed at the central portion of the bottom wall of the outer frame 51*a*** in such a manner that its output shaft is directed toward the upper direction.

Figure 6:
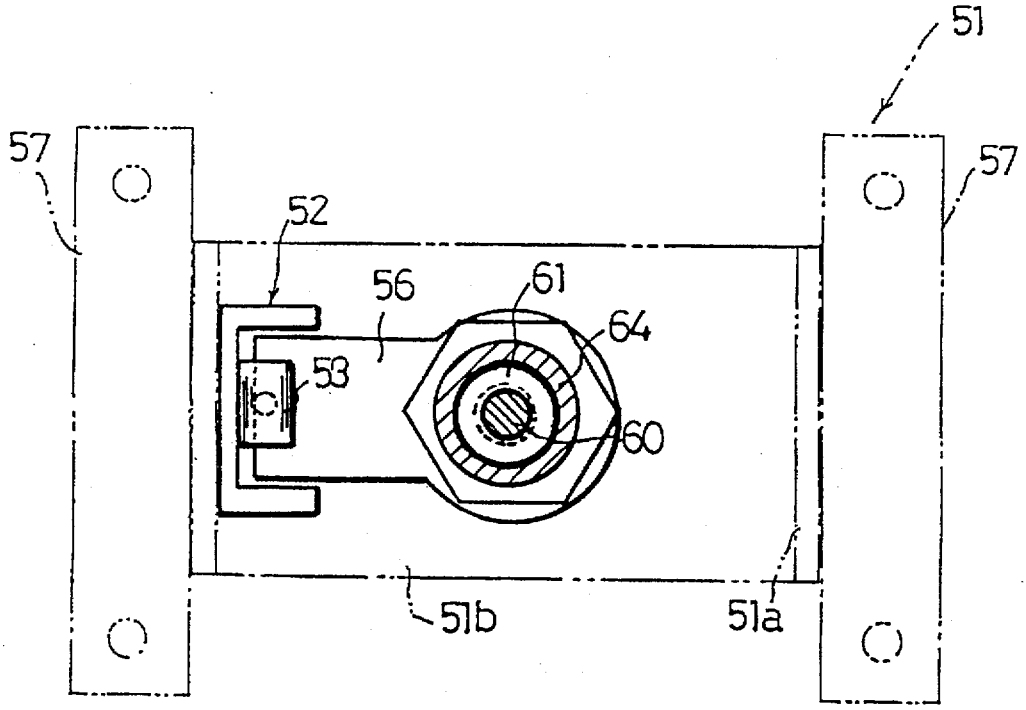
FIG. 6 is an explanatory view of the essential part (working rod member, position detecting sensor, etc.) of the first embodiment.

The vertical plate 52 having the position detecting sensors 53, 54 is formed so that the cross section or the end surface is channel-shaped as shown in FIG. 6, and is fixed at the horizontal pivotal plate **51*b* at the upper portion of the attachment member 51**.

Further, the working rod member 55 is fixed to the output shaft of the drive source 50, and is composed of a vertical screw rod 60 pivoted (pivotally supported) by the horizontal pivotal plate **51*b* of the attachment member 51, a nut 61 is screw-connected to the male screw portion of the vertical screw rod 60, and a working (operation) rod body 64 is adapted so that the nut 61 is fixedly fitted over (with respect to) the lower end portion and it has an opening/closing cover 63 of a bevel-shaped upper wall surface 63*a* at the upper end portion through a fixing member 62. It is to be noted that, with respect to the working rod body 64 and the opening/closing cover 63**, a color or reflection effect test appeals to the visual sense of the player is taken into consideration.

The sensor contact plate 56 is fixed to the nut 61 through fixing members 65 in the horizontal state. The front end portion projected from the nut 61 is faced to the inside of the channel-shaped vertical plate 52 so as to have an ability to come into contact with the position detecting sensors 53, 54. Accordingly, the sensor contact plate 56 is limited by the inner wall surface of the vertical plate 52 so that it is not rotated in the horizontal direction.

Figure 9:
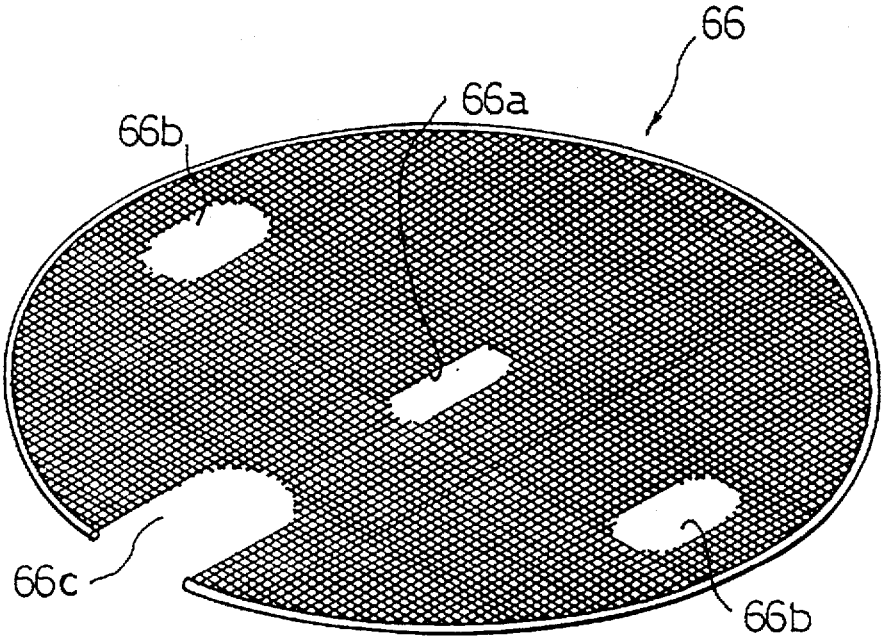
FIG. 9 is a perspective view of the essential part (catching plate) of the first embodiment.

In this embodiment, the opening/closing cover 63 for opening or closing, at a stroke, the lower portion of the ball storage member 4 is adapted so that when the sensor contact plate 56 comes into contact with the movable element of the upper position detecting sensor 53 in a pushing manner, the opening/closing cover 63 is stopped in the state where the lower end opening 30 of the ball storage member 4 is substantially closed, while when the sensor contact plate 56 comes into contact with the movable element of the lower position detecting sensor 54 in a pushing manner, the discrimination ball B within the ball storage member 4 all fall, at a stroke, down to a circular mesh-shaped catching (receiving) plate 66 of metal on the upper surface of the attachment base plate 21 of the vessel 3 see FIG. 9.

Figure 10:
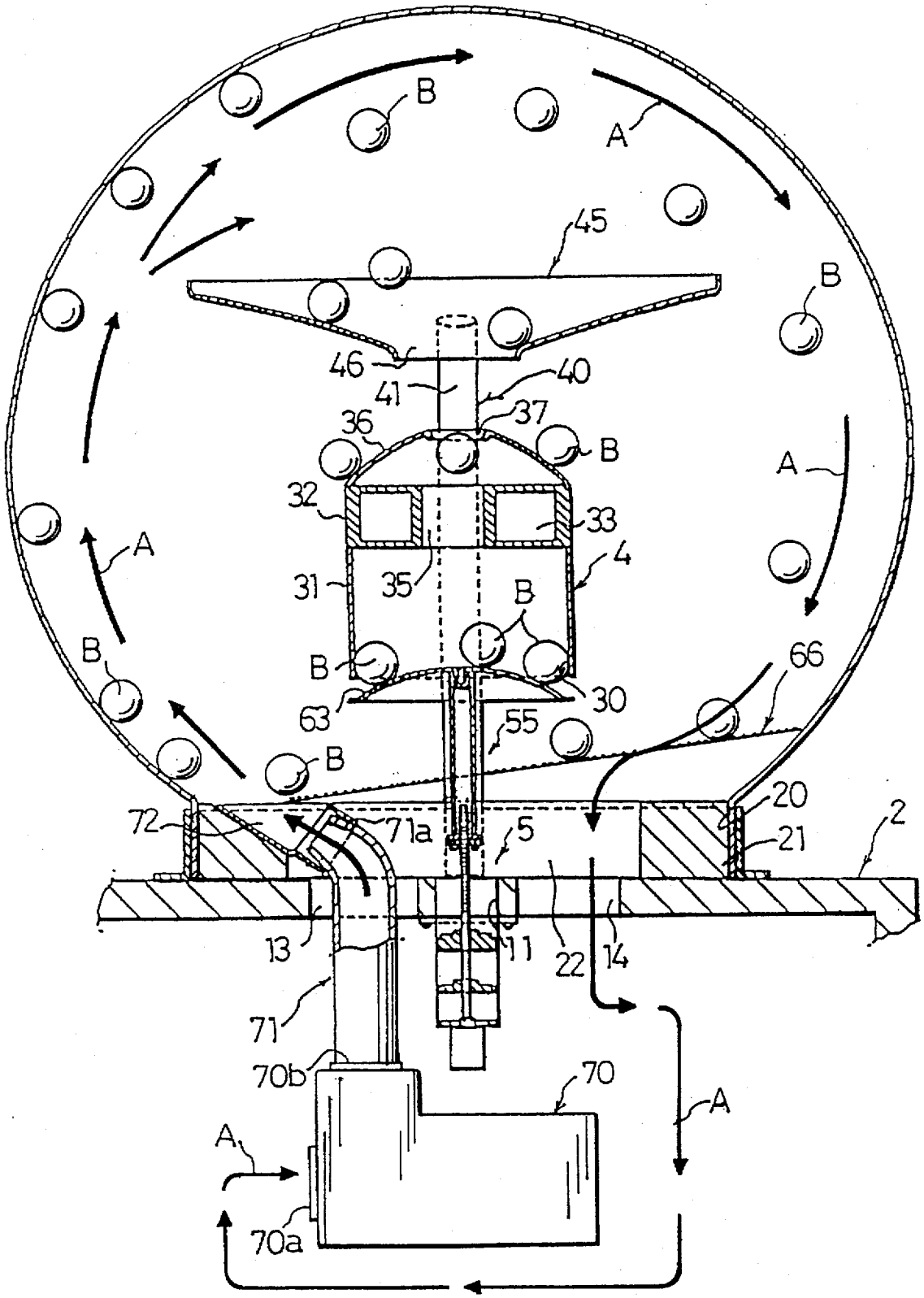
FIG. 10 is an explanatory view showing state of use (particularly flow of air) of the first embodiment.

Meanwhile, as shown in FIG. 9, at the mesh-shaped catching (receiving) plate 66, a first elongated hole 66*a* through which the working rod body 64 of the working rod member 55 is penetrated, second elongated holes 66*b*, 66*b* for pipe-shaped support opposite to each other with the first elongated hole 66*a* being put therebetween, and a cut portion 66*c* for a blast (blowing) hole formed at a suitable portion of the circumferential end portion are formed. For example, as shown in FIG. 10, the mesh-shaped catching (receiving) plate 66 can be set so that the position can be adjusted (in a slightly oblique state) on the upper surface of the base plate 21. The mesh-shaped catching (receiving) plate 66 has elasticity (cushion property) in this embodiment, and the meshes are fine.

Figure 3:
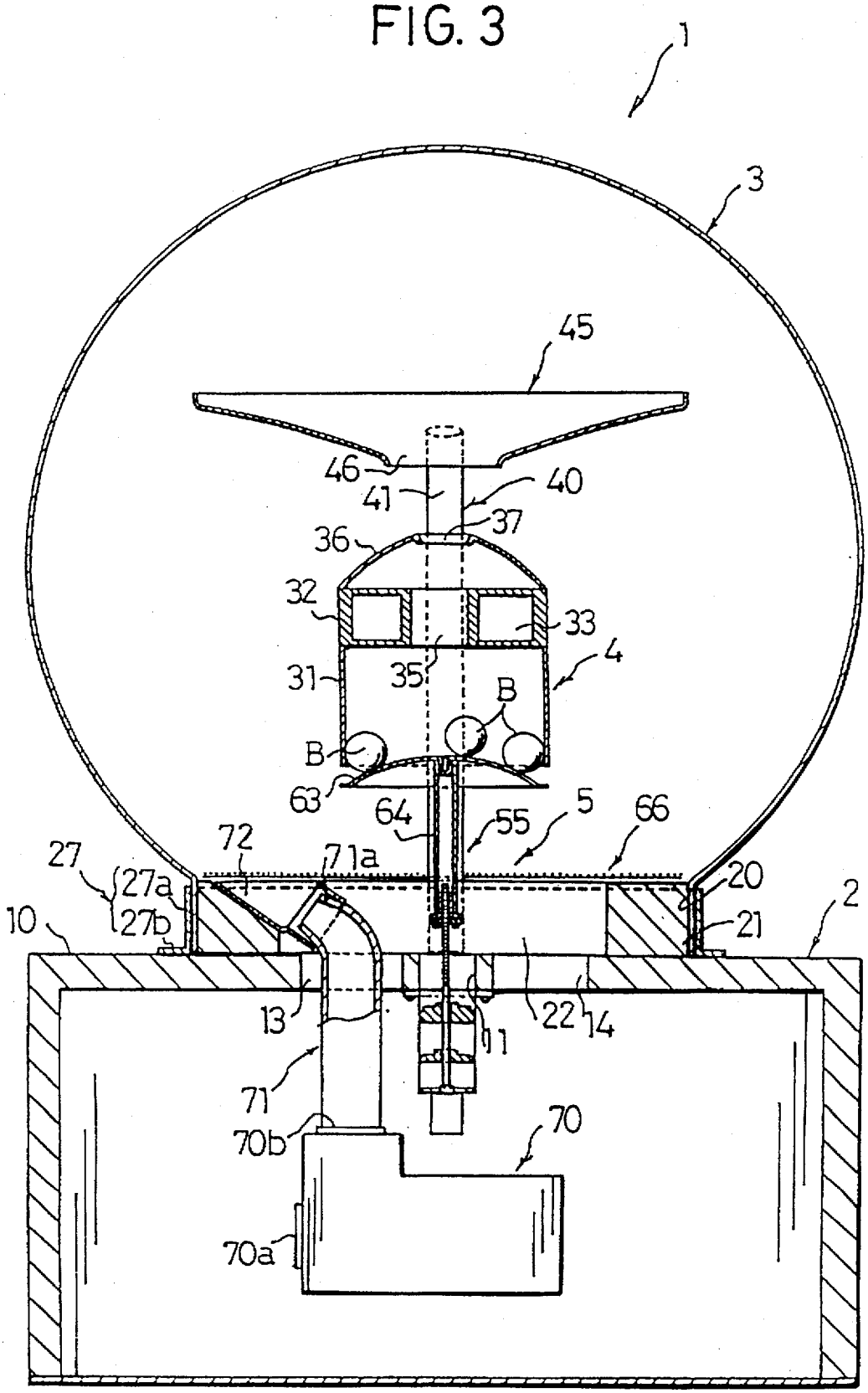
FIG. 3 is a shematic longitudinal cross sectional view based on lines 3—3 of FIG. 1.

Other components which specify this invention will now be described. In FIGS. 1 to 3, reference numeral 70 denotes a blower provided within the base 2. This blower 70 includes an air suction hole 70*a* and a discharge hole 70*b*, and is suitably fixed within the base 2. Reference numeral 71 denotes a blast (blowing) guide member. As this blast guide member, duct or flexible hose, etc. may be employed. In this embodiment, the flexible hose is used as an example of the blast guide member. More particularly, its upper end portion 71*a* is fitted into a rectangular fixed frame 72 fitted into the blast hole 23 of the attachment base plate 21 in an inclined state, and the lower end portion of the blast guide member is connected to the discharge hole 70*b*. Moreover, the fixed frame 72 is formed with a metallic plate, and is suitably fixed on the attachment base plate 21 through a fastening member.

In the above-mentioned configuration, similarly to the general game machine, the bingo game machine 1 reads a program (group of instructions) stored in the memory unit (ROM) of the computer system to sequentially execute those operations.

When it is now assumed that one game starts, and air is blown into the spherical vessel 3 through the blast guide member 71 from the blower 70 within the base 2, air is blown out in one direction from the blast hole 23 of the vessel 3. Thus, air flow is produced along the inner wall surface of the vessel 3. As a result, the discrimination balls B are flown up one after another in a manner to ride on the air flow. The discrimination balls thus flown up do not necessarily fall down into the ball catching dish 45. However, in the case where they fall down into the ball catching dish 45, they may fall down from the ball catching dish 45 by their own force, or may collectively fall down into the center hole 46 while rotating or fall directly.

There are cases where the discrimination balls B falling down through the center hole 46 are admitted (entered) into the catching hole 37 of the ball storage member 4, and there are cases where those balls fall down into the mesh-shaped catching plate 66 as they are. In the case of the former, the balls are passed through the passing (passage) hole 35 of the detecting portion 32, and are stored within the ball storage portion 31. Generally, in the case of the bingo game, when a arrangement of a predetermined number of (e.g., five) balls is completed, "the game comes to the finish". Accordingly, when the predetermined number of discrimination balls B are stored within the ball storage portion 31, one game is completed (finished).

When the drive motor 50 is driven by instruction of the Central Processing Unit (CPU), the vertical screw rod 60 is rotated along with the output shaft. Thus, as shown in FIG. 5, the working rod body 64 falls down until the sensor contact plate 56 comes into contact with the lower position detecting sensor 54 through the nut 61. As a result, the drive motor 50 is stopped. Accordingly, the bevel-shaped opening/closing cover 63 opens, at a stroke, of the lower portion of the ball storage member 4. Thus, the discrimination balls B within the ball storage portion 31 all fall down onto the mesh-shaped catching plate 66.

Thereafter, the drive motor 50 is rotated for a second time by instruction of the Central Processing Unit (CPU). Since the vertical screw rod 60 is in turn rotated in a reverse or backward direction along with the output shaft, the working rod body 64 elevates until the sensor contact plate 56 comes into contact with the upper position detecting sensor 53. As a result, the drive motor 50 is stopped. Accordingly, the bevel-shaped opening/closing cover 63 closes, at a stroke, of the lower portion of the ball storage member 4. Thus, a player can immediately repeat the bingo game.

Meanwhile, FIG. 10 indicates a flow of air during the game. When the blower 70 is driven by instruction of the Central Processing Unit (CPU), air A within the box-shaped base 2 is admitted (sucked) into the suction hole 70*a* of the blower 70. As previously described, since the discharge hole 70*b* of the blower 70 and the blast (blowing) hole 23 at the lower portion of the vessel are connected through the blast guide member 71, the above-mentioned air A is blown out into the vessel 3 from the blast hole 23. In this embodiment, since the front end portion 71*a* of the blast guide member 71 is obliquely directed through the fixed frame 72, the blown out air A flows in one direction along the inner wall surface of the vessel 3. Further, the air A which has blown up the discrimination balls flow in the direction toward the lower portion within the vessel, and flows into the base 2 passing through the mesh-shaped catching plate 66, the opening portion 11 of the vessel, and the penetration hole 14 for return blast (wind) of the base 2. Accordingly, the air A cyclically flows within the base 2 and the vessel 3 without being blown out into the room as indicated by the arrows.

It is to be noted that, in the first embodiment of this invention, the shape of the tubular ball storage portion 31 of the ball storage member 4 is not particularly limited. Since there may be made a change of design such that the supporting member 40 for supporting the ball storage member 4 is caused to be a single supporting arm, it is not necessarily required that the supporting member 40 is constituted with plural members. It is desirable that, for the purpose of allowing the game to be enjoyable, the ball catching dish 45 is disposed with a predetermined space (clearance for escaping the discrimination balls) above the ball storage member 4. The mesh-shaped catching plate 66 may be formed by metal plate material or synthetic resin. It is not necessarily required that the opening/closing cover 63 is bevel-shaped. Moreover, the structure of the detecting portion is not limited to this embodiment, but may employ, e.g., a detecting unit such that a detected member including memory therewithin is embedded into the discrimination ball to carry out a transmission/reception of electromagnetic WAVE between the detected member and the detecting portion constituted by an antenna to thereby discriminate the discrimination balls in a non-contact manner. In short, any detecting section capable of securely discriminating a symbol such as a figure, etc. attached on the discrimination ball may be employed. Although particularly illustrated, a filter member may be attached to the member constituting the circulation path of air (blower 70 or blast guide member 71).

Figure 12:
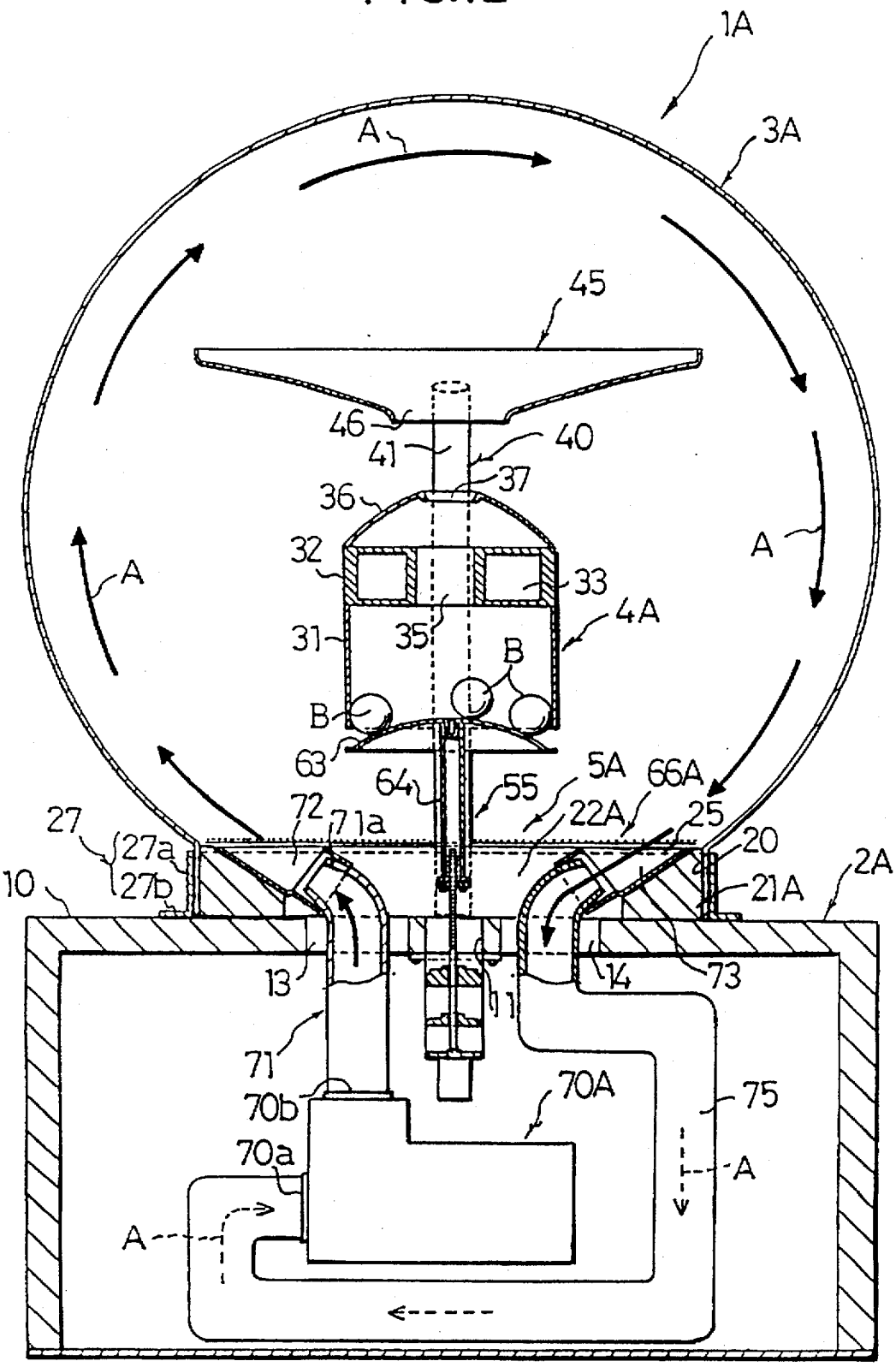
FIG. 12 is a schematic cross sectional explanatory view of a second embodiment.
Figure 13:
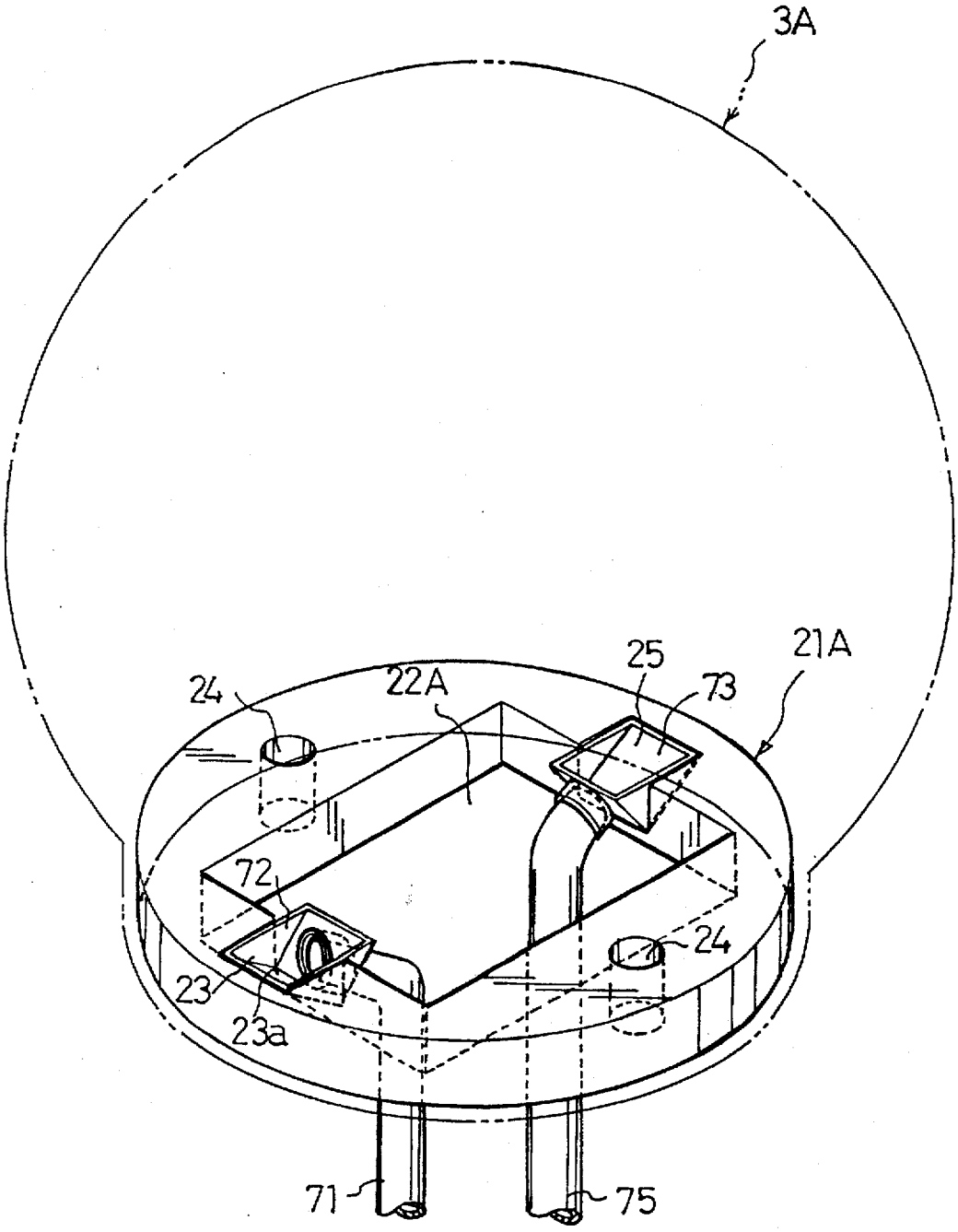
FIG. 13 is an explanatory view as a perspective view showing the essential parts of the second embodiment.
Figure 14:
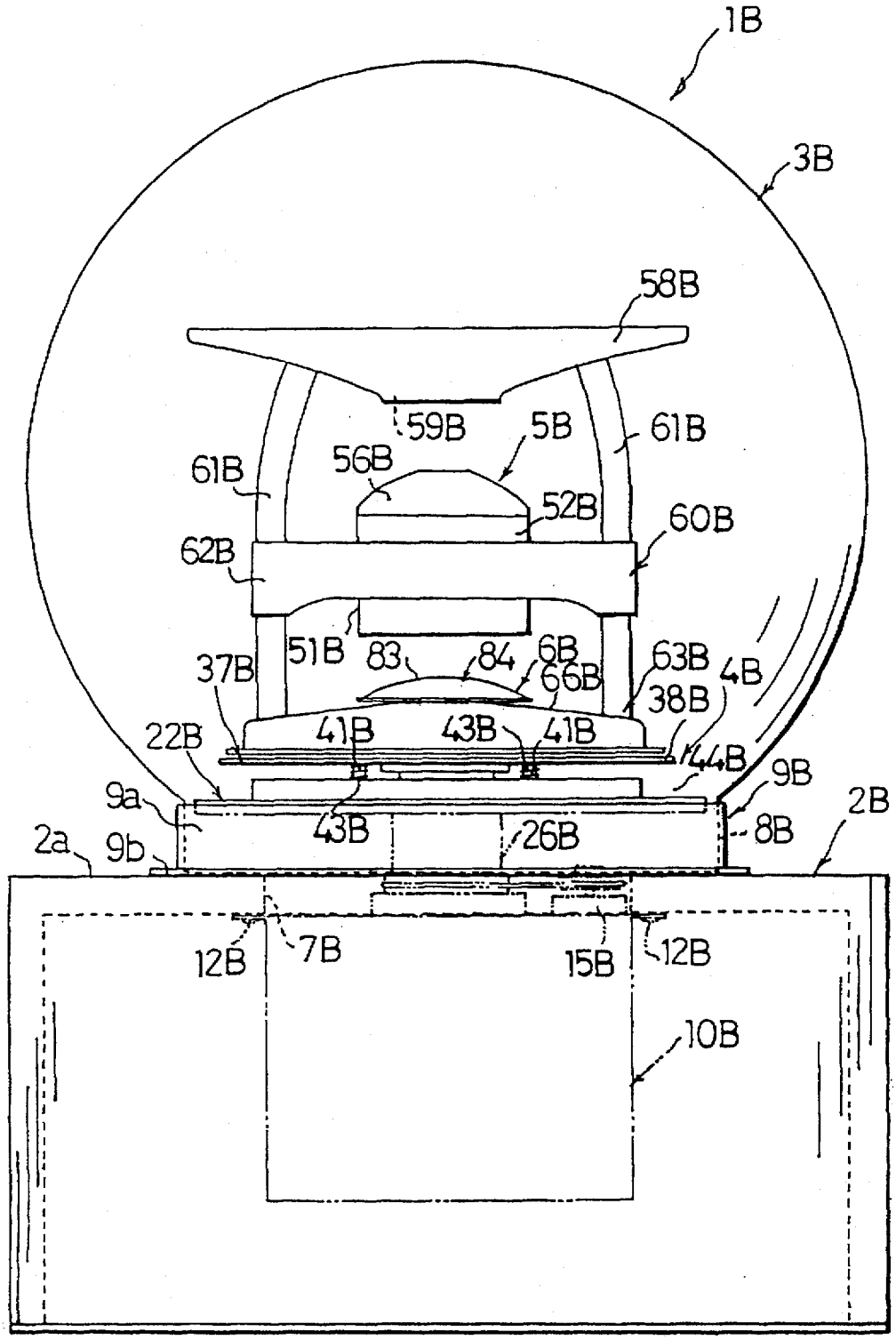
FIG. 14 is a schematic explanatory view showing the entire appearance configuration of a third embodiment.

FIGS. 12 and 13 show the second embodiment of this invention. For convenience, the same reference numerals are respectively attached to the same portions of the first embodiment, and their repetitive explanation will be omitted. The second embodiment is mainly different from the first embodiment in connection with the following points.

Namely, the different points are the fact that a suction (ventilation) hole 25 communicating with a central hole 22A is formed at an attachment (mounting) base plate 21A of a transparent vessel 3A, the fact that a tubular second fixed frame 73 fitted into the suction hole 25 is fixedly attached to the attachment base plate 21A, and the fact that the suction hole 25 and the suction hole **70*a* of the blower 70A are connected through a suction guide member 75 for circulation. It is to be noted that, also in the second embodiment, filter member (not shown) may be attached to members constituting the circulation path of air (e.g., a blast guide member 71, and suction guide member 75 for circulation, etc.). In addition, although it is not necessarily required that the catching plate 66A** is mesh-shaped, at least elasticity should be rendered in that case.

When such a configuration is employed, air A remaining within the vessel 3A is permitted to be positively circulated, and a desired directivity (directional property) can be rendered to air flow within the vessel 3A.

FIGS. 14 to 25 show the third embodiment of this invention. The third embodiment is mainly different from the first embodiment in connection with the following points.

Namely, the different points are the fact that there is employed a configuration adapted for elevating discrimination balls B along the inner wall of the vessel by centrifugal force of two rotary disks, and the fact that a working rod member 75B of a ball discharge (ejection) unit 6B having an opening/closing cover 83 for opening or closing the lower portion of a ball storage member 5B is provided within a pipe-shaped fixed shaft.

The third embodiment will now be described in detail. In the following description, explanation will be briefly given in connection with the respective portions which are the same in configuration as the first embodiment. In addition, symbol "B" is specifically additionally attached to respective reference numerals.

Reference numeral 1B denotes a bingo game machine, reference numeral 2B denotes a base, reference numeral 3B denotes a spherical vessel, reference symbol B denotes discrimination balls, reference numeral 4B denotes a ball flying unit for flying, at a stroke, of plural discrimination balls B along the inner wall of the vessel, reference numeral 5B denotes a ball storage member for detecting, through detecting means, discrimination balls B elevated (flown up) by the ball flying unit 4B and for storing them into the ball storage portion, and reference numeral 6B denotes a ball discharge (ejection) unit having an opening/closing cover for opening or closing, at a stroke, of the lower portion of the ball storage member 5B after one game is completed.

These fundamental constituent members will now be described in order. The base 2B will be first described. The base 2B has a shape of a box having a bottom portion. At the central portion of upper wall **2*a* of the base 2B, a rectangular opening portion 7B** is formed.

The vessel 3B will be subsequently described. The vessel 3B is spherical and is transparent. At the lower portion of the vessel 3B, a circumferential wall 88 projected in a lower direction is formed.

While various attachment methods for the vessel 3B with respect to the base 2B are conceivable. In this embodiment, there is used an annular fixing member 9B composed of a circumferential wall portion **9*a* into which the lower portion of the vessel 3B is detachably fitted and a circumferential collar (flange) portion 9*b* fixed on the upper wall 2*a* of the base 2B**.

The attachment member for the ball flying unit 4B with respect to the base 2B will be subsequently described. This ball flying unit 4B is provided at a shelf-shaped supporting frame 10B fixedly provided within the base 2B and a hollow fixed shaft 11B fixedly vertically provided through the supporting frame 10B at the central portion of the bingo game machine 1.

The shelf-shaped supporting frame 10B is fixed so as to face to the opening portion 7B of the base 2B through a fixing member 12B. This supporting frame 10B is formed so as to have the shape of box opened at the lower end portion thereof, and includes an upper step plate **10*a* positioned substantially at the same horizontal plane surface as the inner wall surface of the upper wall 2*a* of the base 2B, an intermediate (middle) step plate 10*b* opposite to the upper step plate 10*a*, and a lower step plate 10*c* opposite to the intermediate plate 10*b***.

Moreover, the pipe-shaped fixed shaft 11B is provided in a longitudinal direction at the central portion of the supporting frame 10B. In this case, the lower end portion side of the fixed shaft 11B is penetrated through at least the upper step plate **10*a* and the intermediate step plate 10*b*. Further, the lower end portion of the fixed shaft 11*b* is fixed to the lower step plate 10*c* through a fixing member 13B. On the other hand, the upper end portion thereof is projected toward the lower portion of the vessel 3B** therewithin.

The ball flying unit 4B provided at the base 2B through the attachment (mounting) member will now be described. The ball flying unit 4B includes two disk members rotating together in a horizontal direction in the state where plural discrimination balls B are clamped by the circumferential end portion thereof. One is the drive disk rotating in the horizontal state by drive force of a first drive source 15B. The other is the driven disk for clamping plural discrimination balls B by the driven disk and the drive disk by drive force of a second drive source 30B, and rotating in the horizontal state by drive force of the first drive source 15B.

In this case, reference numeral 15B denotes first drive source (drive motor) fixed at one end portion of the upper step plate **10*a*. Reference numeral 16B denotes a ball bearing in which an outer ring 17B is fixed at the central portion of the upper surface of the upper step plate 10*a* of the supporting frame 10B. An inner ring 18B rotatably provided through plural balls is positioned with a required spacing at the outer circumferential wall of the fixed shaft 11B. Reference numeral 19B denotes a doughnut-shaped power transmission plate having circumferential grooves at the outer circumferential wall thereof. This power transmission plate 19B is provided integrally with the inner ring 18B of the ball bearing. In addition, a belt 21B as an example of the power transmission means is laid across the power transmission plate 19B and a pulley 20B provided on the output shaft of the first drive source 15B**.

Meanwhile, the power transmission plate 19B constitutes a portion of the lower end portion of the tubular shaft portion of the drive disk 22B. Accordingly, when the power transmission plate 19B is rotated through the belt 21B by the first drive source 15B, the drive disk 22B is rotated in the same direction along with the power transmission plate 19B.

Figure 20:
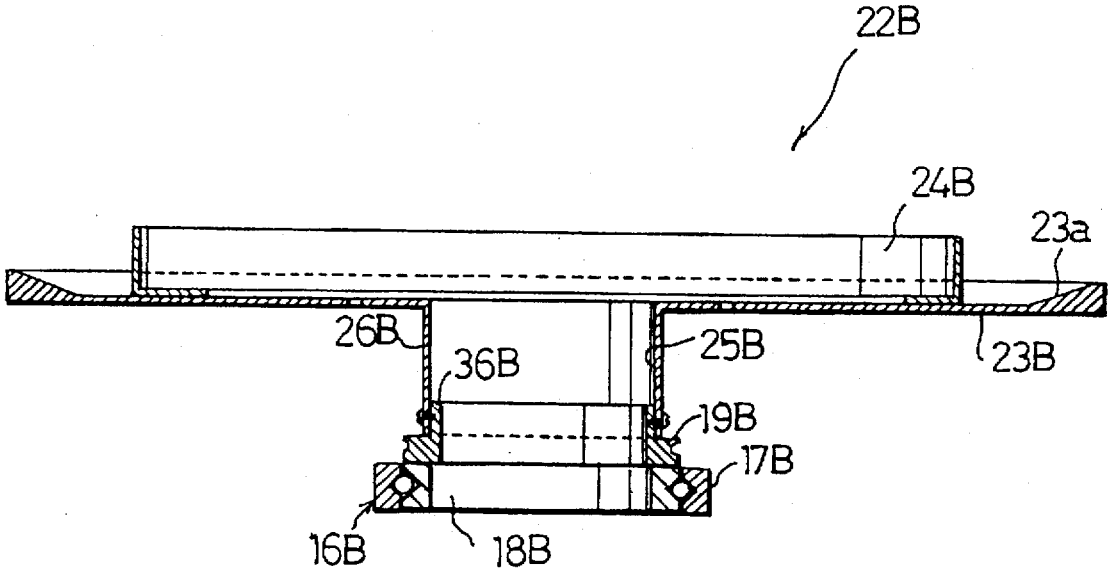
FIG. 20 is a longitudinal cross sectional view of the essential parts (drive disk) of the third embodiment.

In this case, as shown in FIG. 20, the drive disk 22B is composed of a dish-shaped ball catching (receiving) annular portion 23B positioned at the lowest portion within the vessel 3B, a circumferential wall portion 24B integrally provided on the upper surface of the ball catching annular portion, a tubular shaft portion 26B provided in a projected manner at the lower portion of the annular portion 23B so as to face to center hole 25B of the ball catching annular portion 23B, and power transmission plate 19B provided integrally with the lower end portion of the tubular shaft portion 26B. In addition, the dish-shaped ball catching annular portion 23B is formed so that its diameter is greater than the circumferential wall portion 24B in order to permit plural discrimination balls B to ride on the upper surface of the circumferential end portion.

In this case, it is desirable that the circumferential end portion 23*a* of the drive disk 22B is formed to be dish-shaped or trumpet-shaped so that the discrimination balls B can easily elevate along the inner wall surface 3*a* of the vessel 3B, and the discrimination balls B after they have fallen down can easily ride on the circumferential end portion 23*a* of the drive disk 22B. Moreover, at the circumferential end portion 23*a* of the drive disk 22B, engagement portions (e.g., projection for partition, fin-shaped holding piece, circular engagement recessed portion or circular engagement hole, etc.) for respectively supporting plural discrimination balls B may be suitably provided.

On the other hand, reference numeral 30B denotes plural second drive sources (solenoid or drive motor in which the working rod is expanded or contracted, etc.) fixed at the portion close to the central portion of the intermediate step plate 10*b*. As an example of the second drive source 30B, solenoid is used. A pair of solenoids 30B are attached at left and right portions of the intermediate step plate 10*b* so that their working rod 31B are directed immediately or directly toward the above. In addition, engagement portions 32B in a flange form are provided at the upper end portion of the working rods 31B.

Reference numeral 33B denotes an annular engagement disk externally fitted with respect to the portion closer to the lower end portion of the pipe-shaped fixed shaft 11B. This annular engagement disk 33B is slidably provided on the fixed shaft 11B. The annular engagement disk 33B includes a large diameter portion 35B having a circumferential groove 34B with which the engagement portions 32B of the working rods 31B are engaged at all times, and a small diameter portion 36B formed in a projected manner on the upper surface of the large diameter portion 35B.

Reference numeral 37B denotes driven disk provided at the lower portion of the vessel 3B therewithin in a manner opposite to the drive disk 22B. This driven disk 37B is provided on the fixed shaft 11B as previously described so that it can be vertically moved by drive force of the second drive sources 30B.

Figure 21:
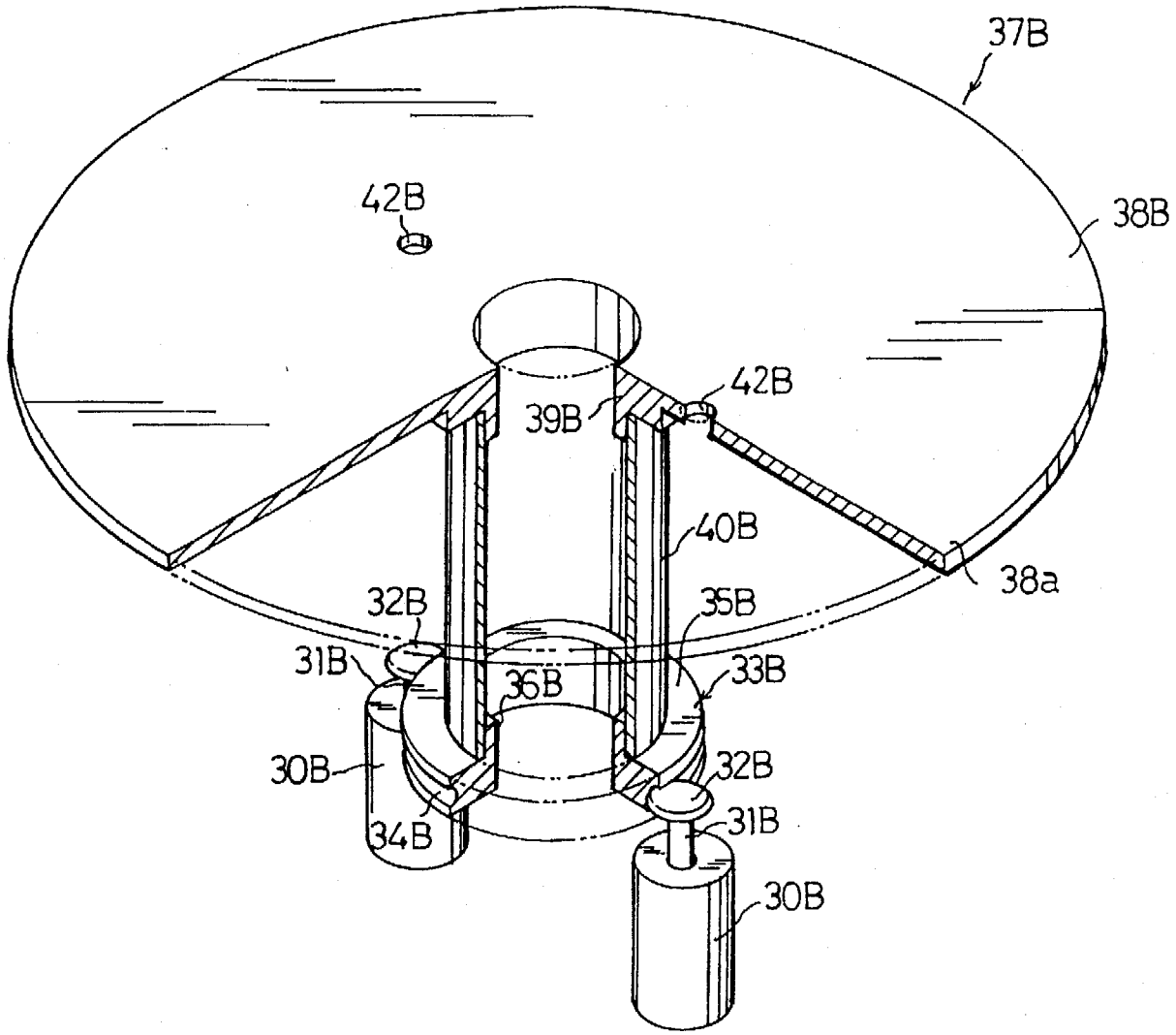
FIG. 21 is a perspective view of essential parts (driven disk) of the third embodiment.
Figure 22:
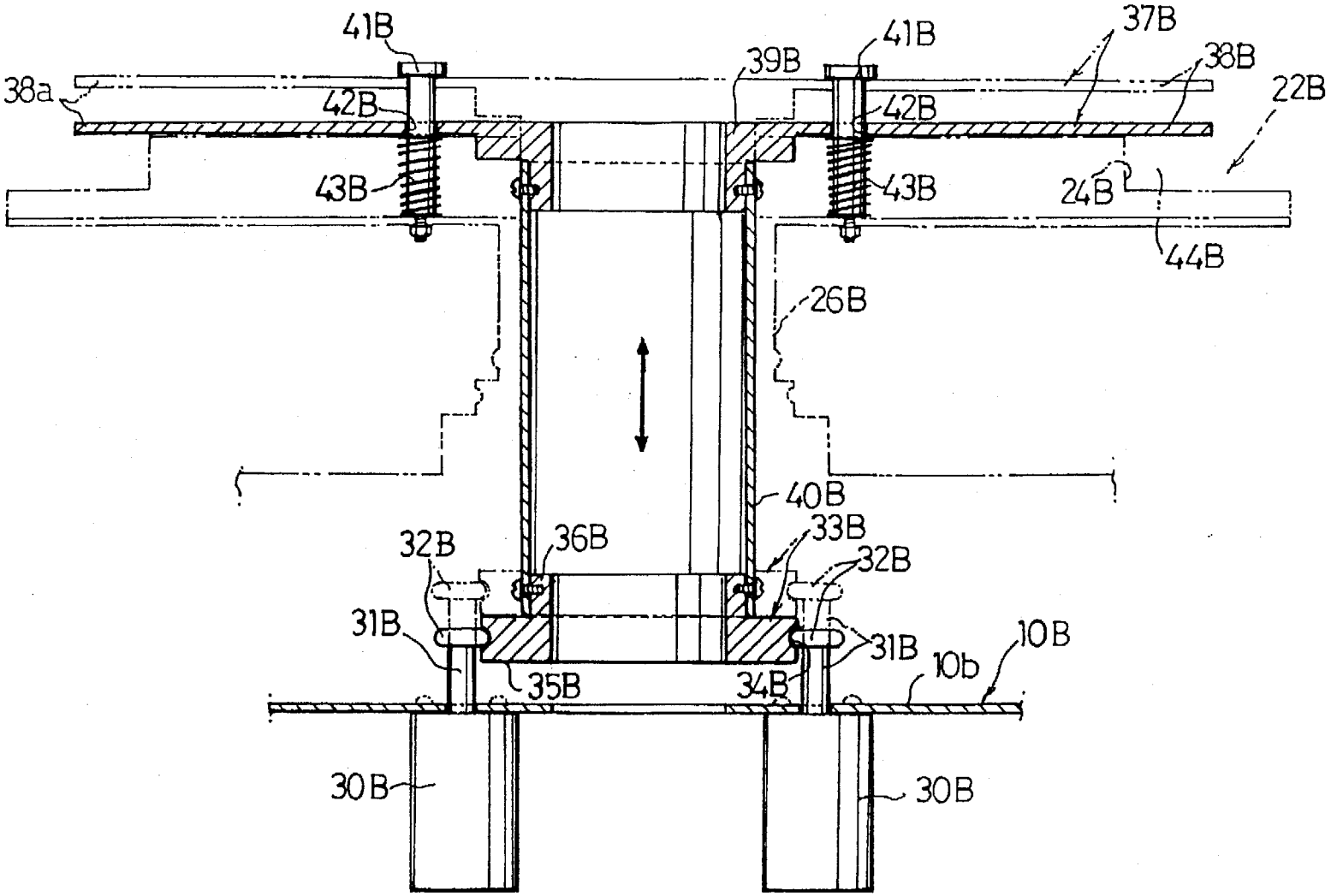
FIG. 22 is an explanatory view showing movement of an essential part (driven disk) of the third embodiment.
Figure 23:
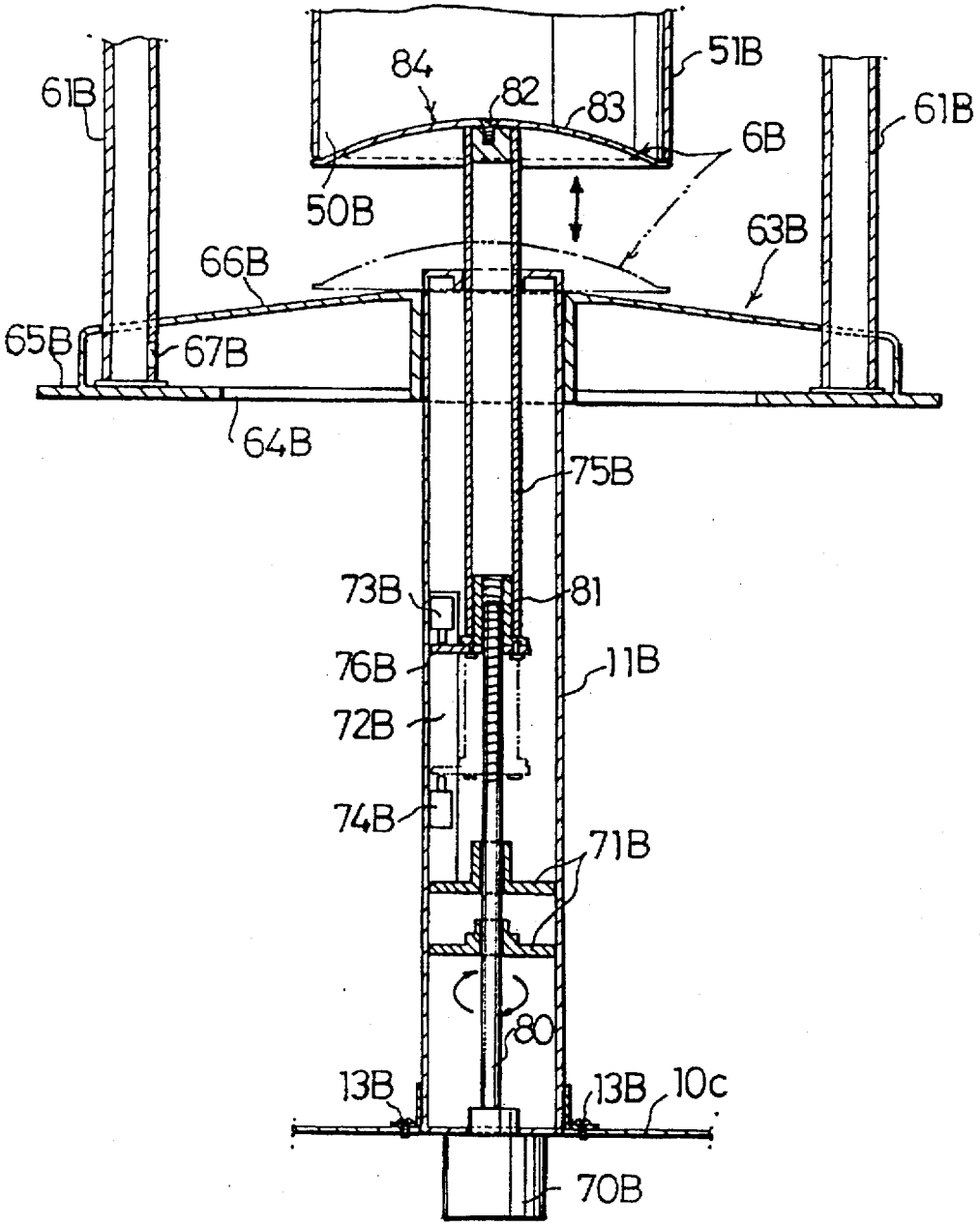
FIG. 23 is an explanatory view of essential parts (discrimination ball discharge unit) of the third embodiment.

In this case, as shown in FIG. 21, the driven disk 37B is composed of a disk-shaped ball supporting portion 38B at the upper portion of the ball catching annular portion 23B and the circumferential wall portion 24B of the drive disk 22B in a manner opposite thereto, a bearing portion 39B formed at the central portion of the ball supporting portion 38B and slidably fitted over (with respect to) the outer circumferential wall of the fixed shaft 11B, and a cylindrical portion 40B for connecting the bearing portion 39B and the annular engagement disk 33B through fastening member. The disk-shaped ball supporting portion 38B of the driven disk 37B is formed so that its diameter is smaller than the dish-shaped ball catching annular portion 23B of the drive disk 22B, but is larger than the circumferential wall portion 24B.

Reference numeral 41B denotes plural synchronization pins provided in the state penetrated into the drive disk 22B and the driven disk 37B. These synchronization pins 41B are provided in the state vertical to both disks 22B, 37B, and are such that their lower end portions are suitably fixed on the drive disk 22B, but their upper end portions are loosely fitted into penetration small holes 42B formed at the driven disk 37B.

Reference numeral 43B denotes plural return springs wound on the synchronization pins 41B. These return springs 43B are interposed between the drive disk 22B and the driven disk 37B, and serve to bias the driven disk 37B in an upper direction at all times. It is to be noted that because return spring 43B can be provided at the solenoid 30B itself, the return spring 43 is not the essential matter (component) of this invention.

In operation, when the working rods 31B of the solenoids 30 are contracted, the driven disk 37B approaches the drive disk 22B against spring force of the return springs 43. On the other hand, when the contracted state of the working rods 31B of the solenoids 30B is released, the driven disk 37B is away from the drive disk 22B by spring force of the return spring 43B.

Accordingly, plural discrimination balls B which have been admitted into a space portion 44B formed by the circumferential end portion 23*a* of the ball catching annular portion 23B and circumferential end portion 38*a* of the disk-shaped ball supporting portion 38B are released from the both disks 22B, 37B, or are clamped therebetween by expanding or contracting movement of the working rods 31B of the solenoids 30B.

The ball storage member 5B FIGS. 15, 25 will now be described. Since the configuration of the ball storage member 5B is the same as that of the first embodiment, brief explanation will be given. Reference numeral 50B denotes a lower end opening, reference numeral 51B denotes a tubular ball storage portion, reference numeral 52B denotes a doughnut shaped detecting portion, reference numeral 53B denotes an annular chamber of the detecting portion, reference numeral 54B denotes detecting means, reference numeral 55B denotes a passing (passage) hole, reference numeral 56B denotes a cap, reference numeral 57B denotes a catching (receiving) hole, reference numeral 58B denotes a ball catching (receiving) dish, and reference numeral 59B denotes a center hole.

A supporting member 60B for the ball storage member 5B will now be described. The ball storage member 5B is fixedly disposed at a portion slightly lower than the central portion of the vessel 3B through the supporting member 60B provided within the vessel.

In this embodiment, the supporting member 60B is composed of two pipe-shaped supports 61B and a plate-shaped supporting arm 62B. When FIG. 15 is taken as a reference, a pair of pipe-shaped supports 61B are opposite to each other in left and right directions with a required spacing therebetween, and are adapted so that respective lower end portions thereof are fixed on an attachment (mounting) base plate 63B fixedly externally fitted with respect to the upper end portion of the fixed shaft 11B.

The attachment base plate 63B is disk-shaped as a whole, and is adapted so that a fitting hole through which the fixed shaft 11B is penetrated is formed at the central portion thereof. Further, the attachment base plate 63B includes an annular cut portion 64B, and is composed of a base portion 65B having a diameter smaller than that of the drive disk 22B and a slanting surface portion 66B which is integrally provided at the upper portion of the base portion 65B and takes a bevel shape to some extent.

Figure 15:
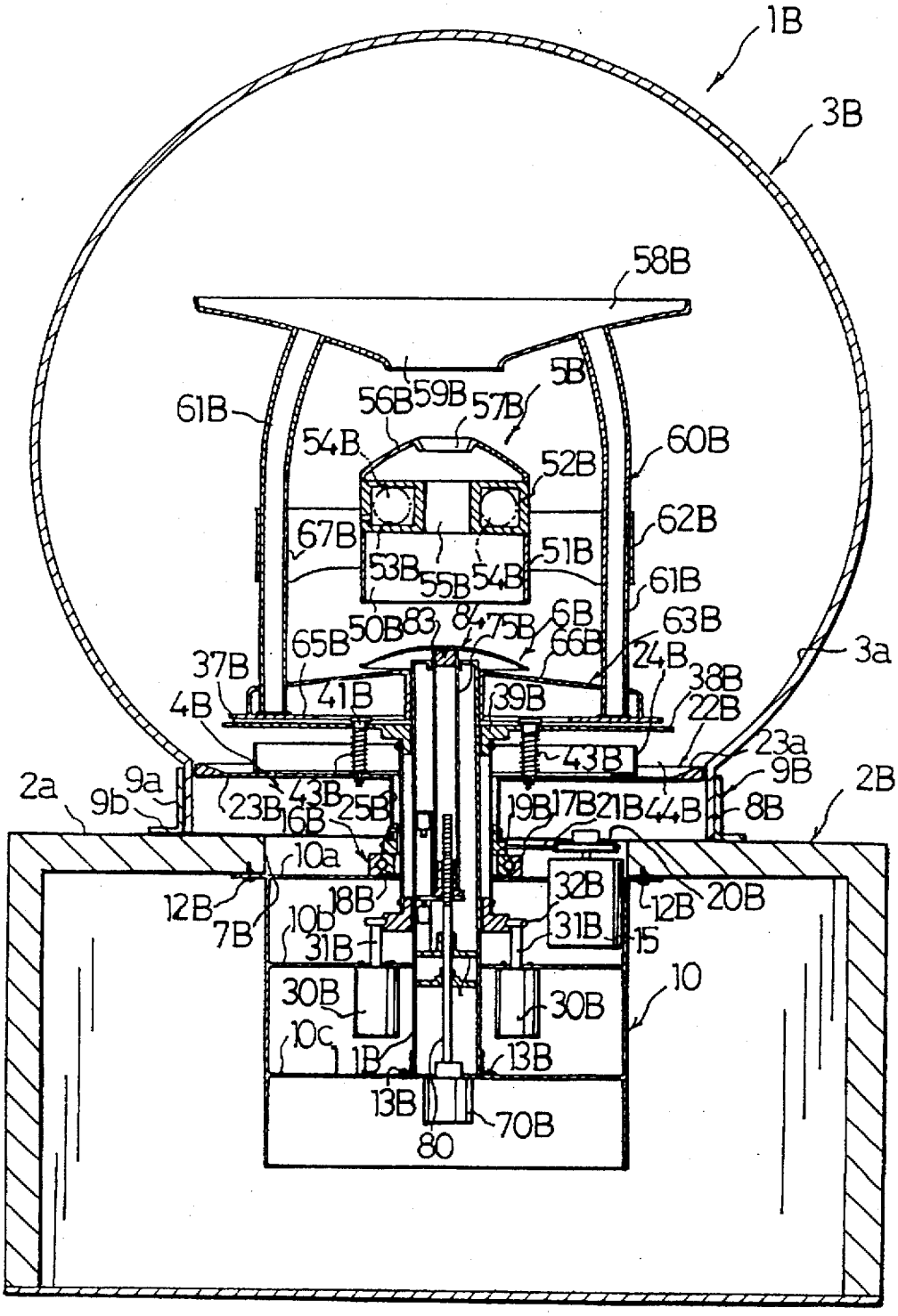
FIG. 15 is a schematic longitudinal cross sectional view when
Figure 16:
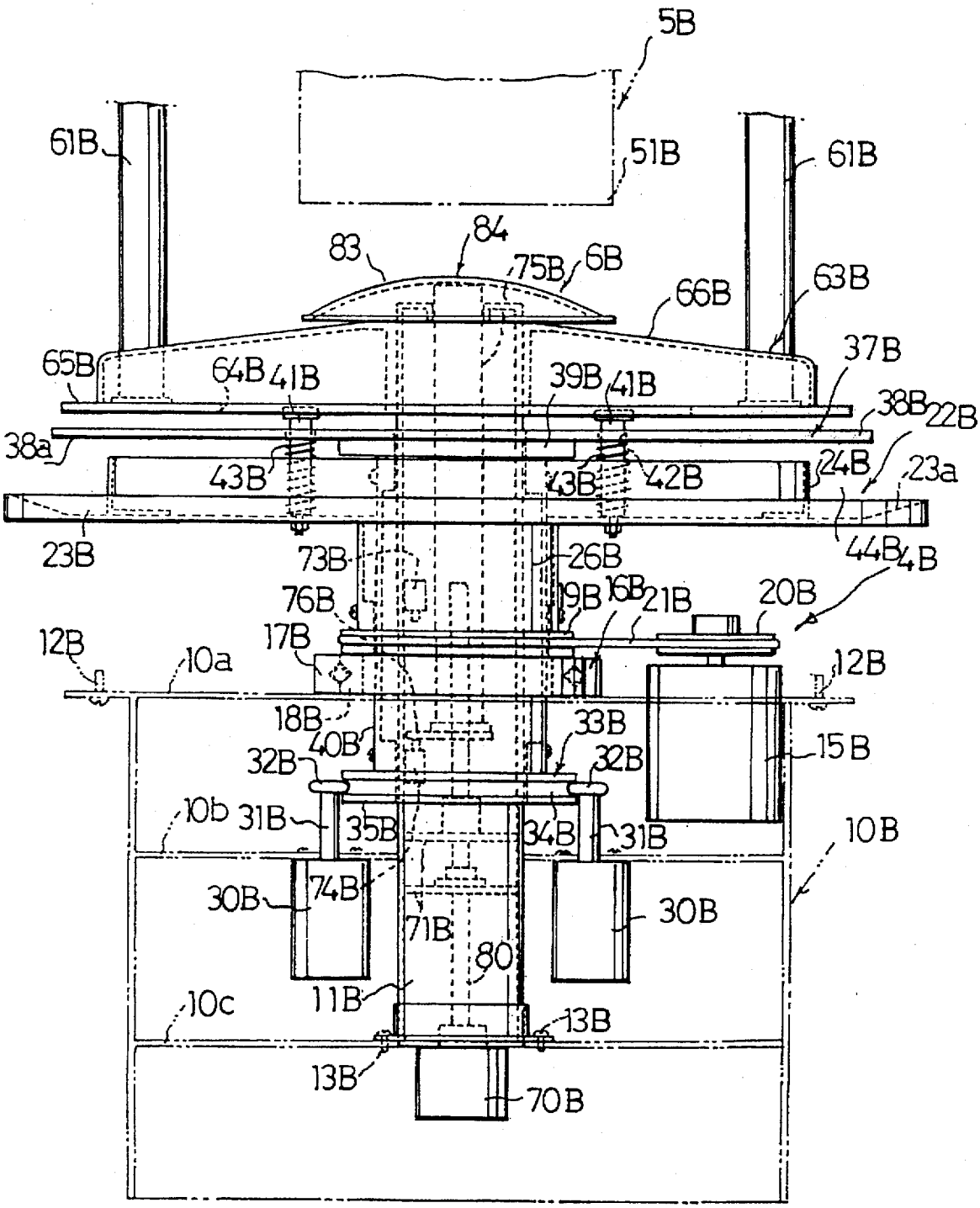
FIG. 16 is an explanatory view of essential parts of a third embodiment.
Figure 17:
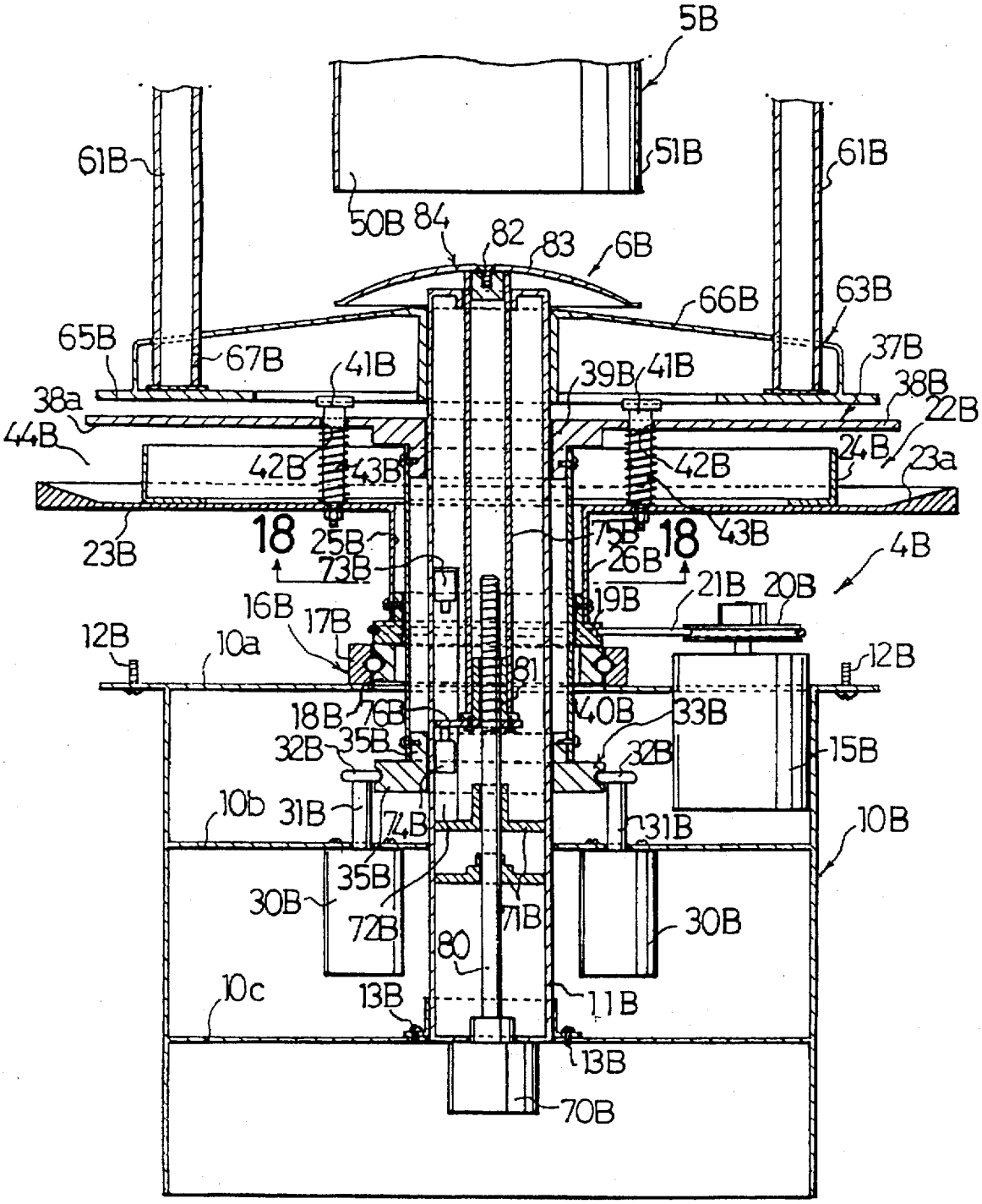
FIG. 17 is a schematic longitudinal cross sectional view of FIG. 16.
Figure 18:
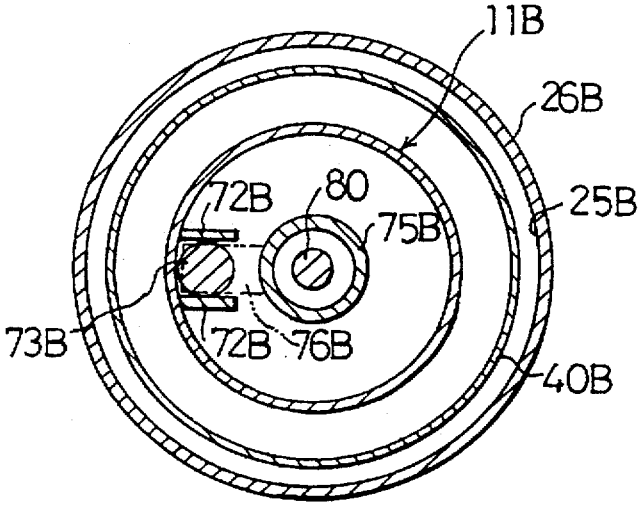
FIG. 18 is an enlarged end surface view along the 18—18 lines of FIG. 17.

Reference numeral 67B denotes plural small holes formed at the pipe-shaped support 61B as shown in FIGS. 15 and 17, and adapted for guiding a wiring cord for the detecting means into the support.

Figure 19:
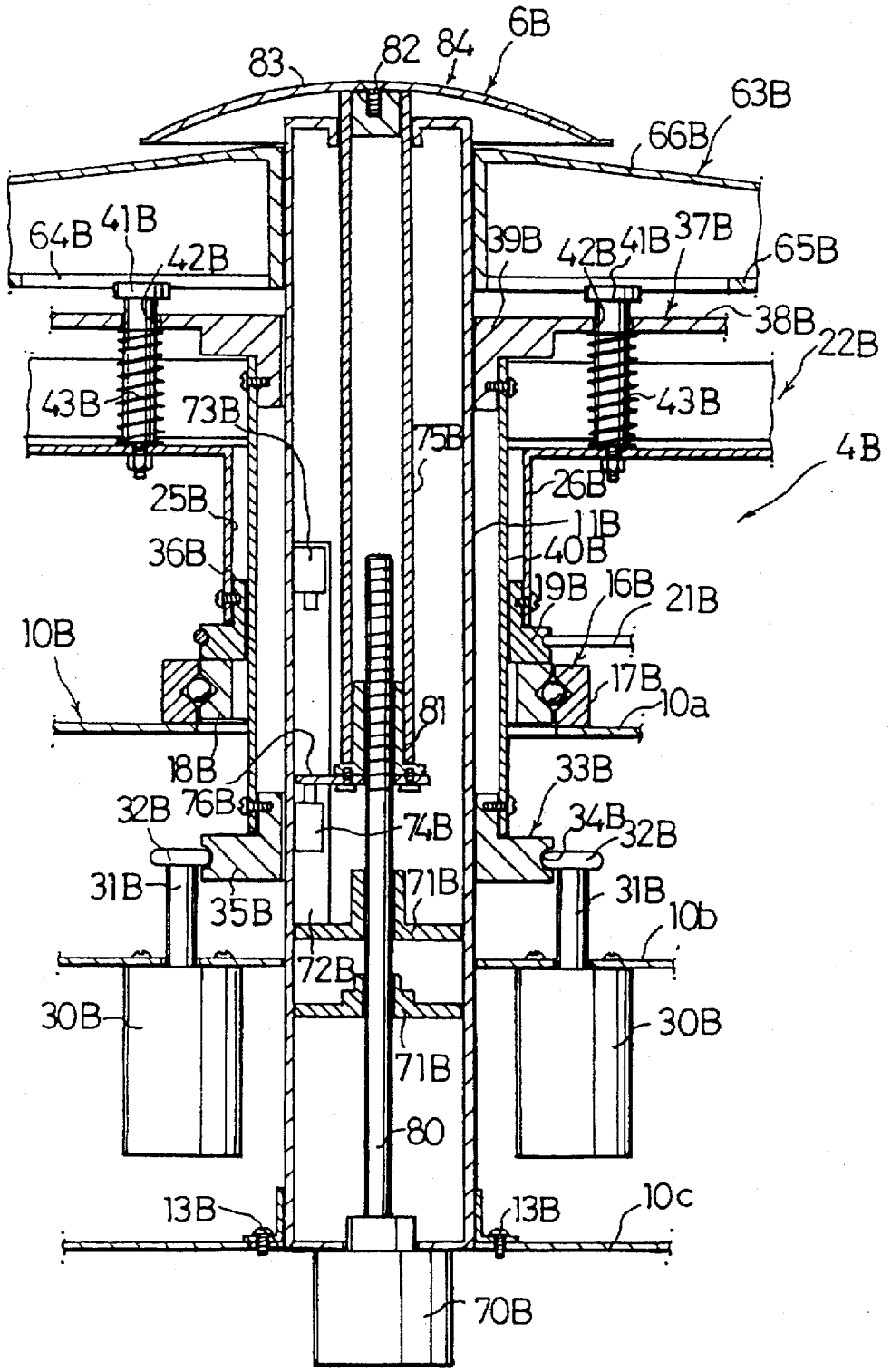
FIG. 19 is an explanatory view of essential parts of the third embodiment.

The discrimination ball discharge unit 6B will now be described. This discrimination ball discharge (ejection) unit 6B includes third drive source 70B fixed on the supporting frame 10B or the fixed shaft 11B as shown in FIG. 19, and are adapted so that many members thereof are provided within the fixed shaft 11B except for the opening/closing cover for the ball storage member.

This discrimination ball discharge (ejection) unit 6B is essentially composed of a third drive source 70B directly or indirectly attached at the lower end portion of the fixed shaft 11B, plural position detecting sensors 73B, 74B disposed in upper and lower directions through a pair of vertical plates 72B are fixed within the fixed shaft 11B, a working rod member 75B vertically movable by a drive force of the third drive source 70B, and a sensor contact plate 76B fixedly provided at the working rod member 75B. The respective constituent members will now be described.

As an example of the drive source 70B, a small-sized drive motor is employed. The drive source 70B is fixed to the fixed shaft 11B with the output shaft being directed toward the upper direction.

Moreover, reference numeral 71B denotes two horizontal pivotal plates fixed in upper and lower directions with a required spacing therebetween within the fixed shaft 11B. The vertical plates 72B having the position detecting sensors 73B, 74B are positioned above these horizontal pivotal plates 71B.

Further, the working rod member 75B is composed of a vertical screw rod 80 fixed to the output shaft of the drive source 70B, and pivoted at (pivotally supported by) the horizontal pivotal plate 71B, a nut 81 screw-connected to the male screw portion of the vertical screw rod 80, and a working rod body 84 adapted so that the nut 81 is fixedly fitted at the lower end portion and it has a bevel-shaped opening/closing cover 83 fixed through a fixing member 82 at the upper end portion. The bevel-shaped opening/closing cover 83 is positioned at a position above the slanting surface portion 66B bevel-shaped to some extent of the attachment base plate 63B.

Further, the sensor contact plate 76B is fixed to the nut 81 in the horizontal state, and is such that the front end portion projected from the nut 81 is faced to the inside of the vertical plate 72B so that it can come into contact with the position detecting sensors 73B, 74B. Accordingly, the sensor contact plate 76B is limited by the inner wall surface of the vertical plate 72 so that it is not rotated in the horizontal direction.

The opening/closing cover 83 for opening or closing, at a stroke, the lower portion of the ball storage member 5B is adapted so that when the sensor contact plate 76B comes into contact with the movable element of the upper position detecting sensor 73B in a pushing manner, the opening/closing cover 83 is stopped in the state where the lower end opening 50B of the ball storage member 5B is substantially in a closed state, while when the sensor contact plate 76B comes into contact with the movable element of the lower position detecting sensor 74B in a pushing manner, the discrimination balls B within the ball storage member 5B all fall, at a stroke, down to the slanting surface 66B of the attachment base plate 63B of the vessel 3B. Then, the discrimination balls B are admitted into the space portion 44B of the drive disk 22B and the driven disk 37B while rotating along the slanting surface portion 66B.

The operation of the bingo game machine 1B will now be described.

Figure 24:
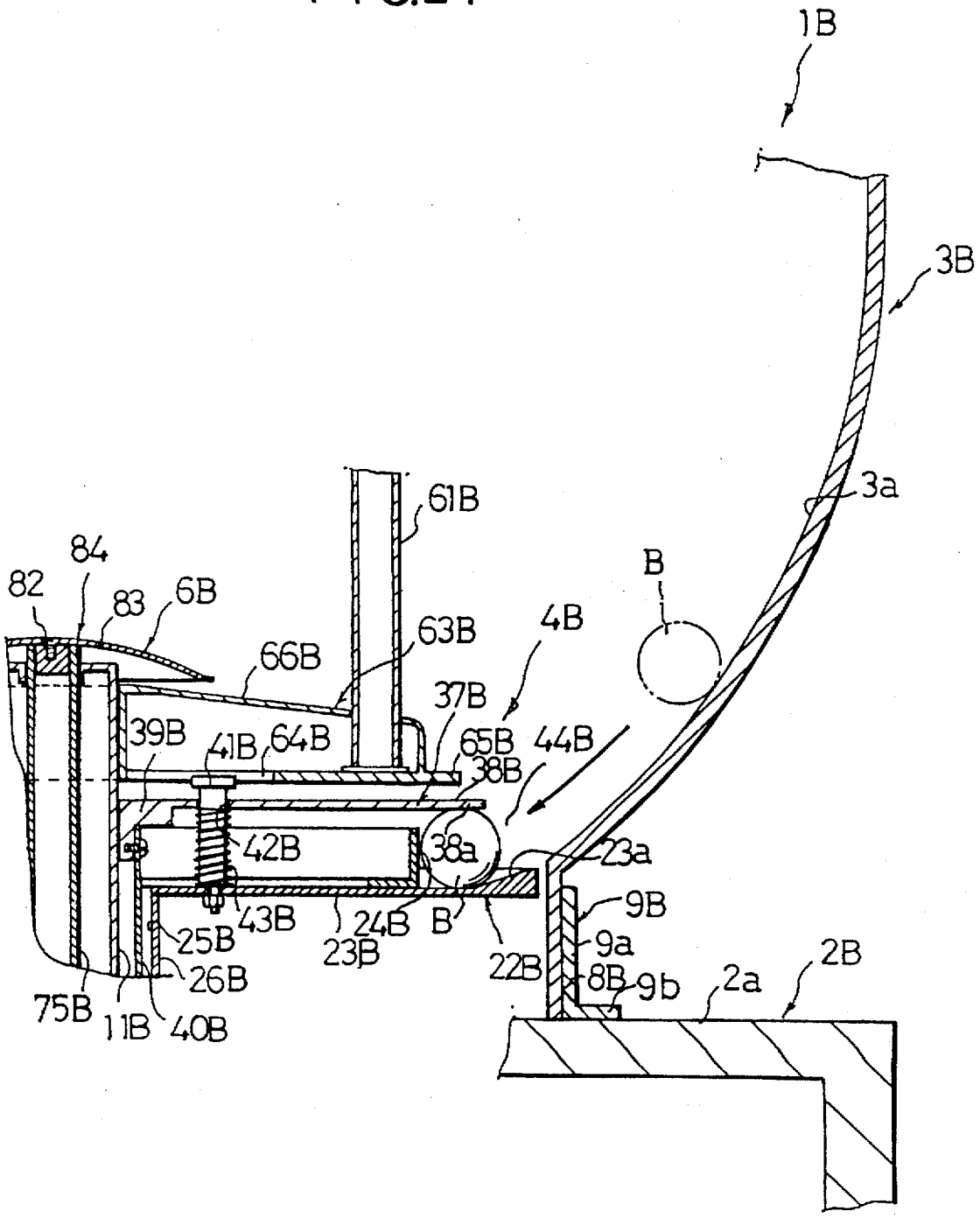
FIG. 24 is an explanatory view in the case where discrimination balls are clamped by two disks of the third embodiment.

Assuming now that one game is started, and the second drive sources (solenoids) 30B are in the energized state so that the working rods 31B are contracted in the state where plural discrimination balls B are admitted into the space portion 44B between the drive disk 22B and the driven disk 37B as shown in FIG. 24, the driven disk 37B approaches the drive disk 22B against the spring force of the return springs 43B of the synchronization pins 41B. Accordingly, plural discrimination balls B are clamped by the circumferential end portions **23*a*, 38*a* of the both disks 22B, 37B**.

When the first drive source 15B is driven, the drive disk 22B rotates through the power transmission means 15B. At this time, the driven disk 37B is rotated synchronously with the drive disk 22B in the state where it pushes plural discrimination balls B from the upper side onto the drive disk 22B and through the synchronization pins 41B.

Figure 25:
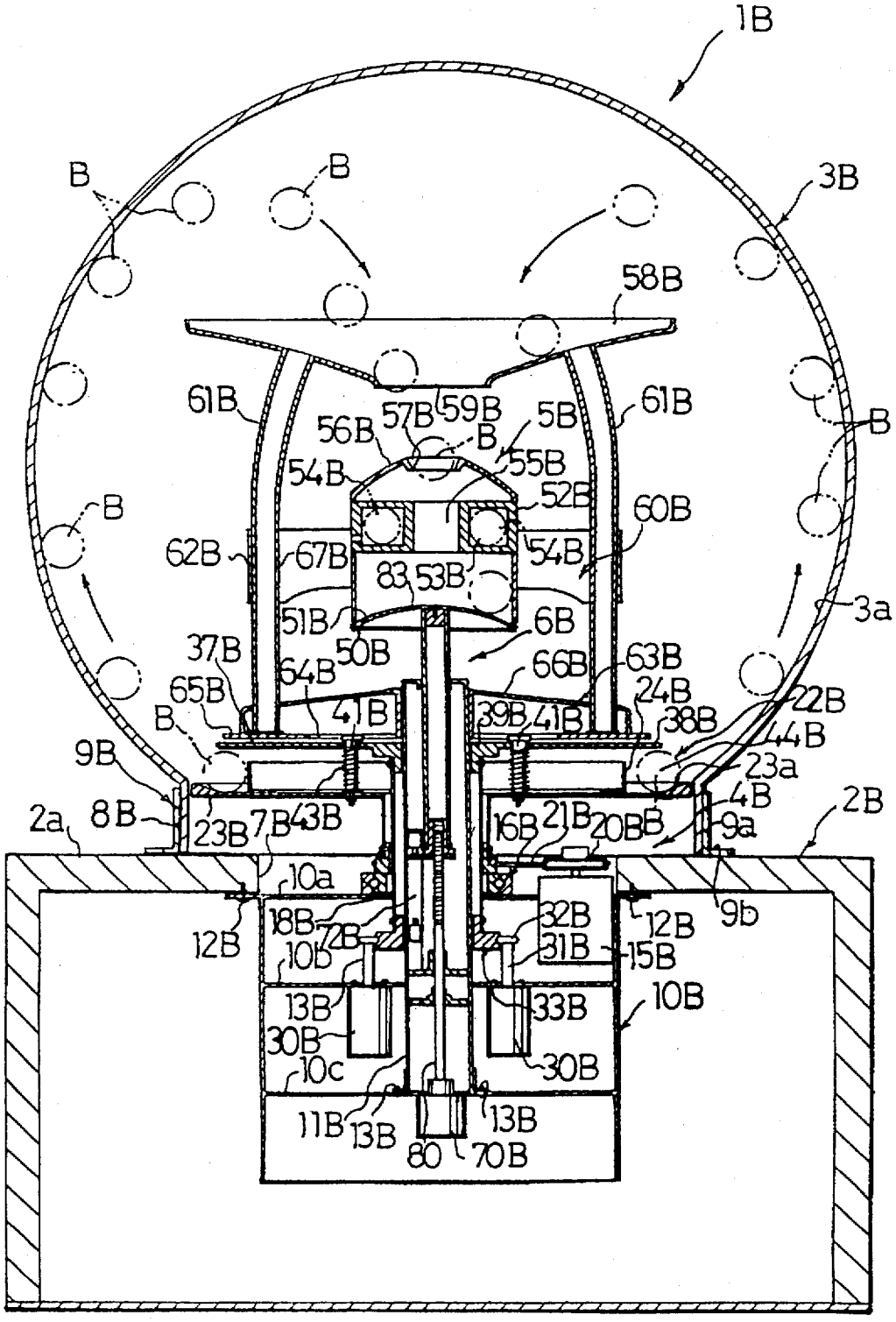
FIG. 25 is an explanatory view in the case where the discrimination balls are released from both disks of the third embodiment.

When the second drive source 30B is brought into non-energized state during rotation of the both disks so that the both disks are away from each other by the spring force of the return springs 43B, plural discrimination balls B fly up with good balance at a stroke along the inner wall **3*a* of the vessel 3B by the centrifugal force as shown in FIG. 25**.

There are instances where the discrimination balls B which have fallen down through the center hole 59B are admitted into the catching (receiving) hole 57B of the ball storage member 5B, and there are instances where those balls fall down to the drive disk as they are. In the case of the former, those balls B are passed through the passing (passage) hole 55B of the detecting portion 52B, and stay at the ball storage portion 51B.

As previously described, generally in the case of the bingo game, when arrangement of a predetermined number of (e.g., five) discrimination balls is completed, "one game comes to the finish". Accordingly, the above-mentioned operations are repeated several times until a predetermined number of discrimination balls B are stored within the ball storage portion 51B (one game is finished).

When one game is finished (completed), the third drive source (drive motor) 70B is driven by instruction of the Central Processing Unit (CPU). When the vertical screw rod 80 is thus rotated, the working rod body 84 falls down until the sensor contact plate 76B comes into contact with the lower position detecting sensor 74B through the nut 81. As a result, the drive motor 70B is stopped. Accordingly, the bevel-shaped opening/closing cover 83 opens, at a stroke, the lower portion of the ball storage member 5B. Thus, discrimination balls B within the ball storage portion 51B all fall down.

Thereafter, the drive motor 80 is driven for a second time by instruction of the Central Processing Unit (CPU). As a result, the vertical screw rod 80 is rotated in turn in reverse (backward) direction along with the output shaft. For this reason, the working rod body 84 elevates until the sensor contact plate 76B comes into contact with the upper position detecting sensor 73B. As a result, the drive motor 70B is stopped. Accordingly, the bevel-shaped opening/closing cover 83 closes, at a stroke, the lower portion of the ball storage member 5B. Thus, player can immediately repeat the bingo game.

It is to be noted that the essential part may be changed in design in the above-described third embodiment.

First is the case where the ball storage member 5B is fixed to the vessel 3B itself through pipe supports 61B without indirectly fixing the ball storage member 5B to the attachment (mounting) base plate 63B.

Second is the case where when the working rods 31B of the solenoids 30B of the ball flying unit 6B is expanded, the driven disk 37B is away from the drive disk 22B, while when the expanded state of the working rod 31B is released, the driven disk 37B approaches the drive disk 22B by spring force of the spring members 43B wound at the upper end portion of the synchronization pins 41B. Even if such a configuration is employed, the same effects/advantages as those of the third embodiment can be provided as long as the fundamental configuration of this invention is utilized.

As is clear from the foregoing description, advantages as recited below are provided in this invention.

(1) It is possible to automatically and immediately carry out a series of operations such as elevation, detection, storage and discharge (ejection) into the vessel of discrimination balls, etc. without discharging (ejecting) the discrimination balls from the vessel toward the external.

(2) The inner wall surface of the vessel and/or the discrimination balls do not become soiled by air or dust within the room. Moreover, since air is not positively injected from the vessel, no feeling of discomfort is given to a player.

(3) It is possible to elevate plural discrimination balls along the inner wall of the vessel, or to blow them off. Particularly, in the case of the first and second embodiments, it is possible to efficiently blow up discrimination balls one after another. In the case of the third embodiment, it is possible to blow, at a stroke, discrimination balls in a good balanced state.

(4) When one game comes to the finish, it is possible to discharge (eject), at a stroke, discrimination balls within the ball storage member into the vessel.

(5) In the case of the embodiment where the opening/closing cover is formed in a bevel form or obliquely, any discrimination ball is not left within the ball storage member when discrimination balls are discharged (ejected).

(6) In the case of the embodiment where the circumferential end portion of the drive disk of the ball flying unit is formed in a dish form, it is possible to easily elevate discrimination balls along the inner wall surface of the vessel, or to allow discrimination balls which have fallen (dropped) to easily ride on the circumferential end portion of the drive disk.

(7) In the case of the embodiment where synchronization pins for connecting the drive disk and the driven disk are provided, it is possible to securely synchronously rotate the both disks.

(8) In the case of the embodiment where the working rod member of the discrimination ball discharge (ejection) unit is provided within the pipe-shaped fixed shaft, respective units can become compact.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A bingo game machine comprising a base, a spherical vessel attached on an upper wall of the base, plural discrimination balls accommodated within the vessel, elevating means for elevating these discrimination balls, means for catching the elevated discrimination balls to detect them, a ball storage member for storing the discrimination balls discriminated by a detecting means into a ball storage portion, and a ball discharge unit provided, in a longitudinal direction, with a working rod member having an opening/closing cover for opening a lower end opening of the ball storage member, thus to continuously carry out elevation, detection, storage and discharge of the discrimination balls within the vessel.

2. A bingo game machine as set forth in claim 1, wherein the ball storage member is fixedly disposed through a supporting member within the vessel, and the working rod member is provided in a longitudinal direction within the vessel and the base.

3. A bingo game machine as set forth in claim 1, wherein the ball storage member is composed of a tubular ball storage portion, a detecting portion continuously formed at an upper portion of the tubular ball storage portion and including therewithin said detecting means for discriminating the discrimination balls that pass through a passing hole, and a cap fixedly provided at an upper portion of the detecting portion and including a receiving hole for permitting the discrimination balls to be passed therethrough.

4. A bingo game machine as set forth in claim 1, wherein the discrimination ball discharge unit includes an attachment member provided with a drive source, plural position detecting sensors disposed in upper and lower directions through a vertical plate at the attachment member, a working rod member vertically movable by a drive force of the drive source, and a sensor contact plate fixedly provided at the working rod member.

5. A bingo game machine as set forth in claim 1, wherein the working rod member is composed of a vertical screw rod fixed to an output shaft of a drive source and pivotally supported by a horizontal pivotal plate of an attachment member, a nut screw-connected to a male screw portion of the vertical screw rod, and a working rod body adapted so that a nut is fixedly fitted at the lower end portion and the vertical rod has an opening/closing cover fixed at an upper end portion.

6. A bingo game machine as set forth in claim 1, wherein the working rod member of the ball discharge unit is positioned within a pipe-shaped fixed shaft provided at a supporting frame within the base.

7. A bingo game machine as set forth in claim 1, wherein the opening/closing cover has a slanting surface such that the discrimination balls naturally fall down therealong.

8. A bingo game machine comprising a box-shaped base, a transparent vessel attached on an upper wall of the base, a ball storage member fixedly disposed within the vessel and adapted for storing several discrimination balls discriminated by a detecting means, and a discrimination ball discharge unit having an opening/closing cover for opening or closing a lower portion of the ball storage member, an air blower that is disposed within the base, an air blast guide member is interposed between a discharge hole of the blower and an air blast hole at a lower portion of the vessel, whereby air which has been blown out into the vessel from the blast hole returns into the base through an opening portion at the lower portion of the vessel, and cyclically flows into an air suction hole of the air blower.

9. A bingo game machine as set forth in claim 8, wherein an attachment base plate is fixedly provided at the lower portion of the vessel, and a mesh-shaped catching plate is provided on an upper surface of the attachment base plate.

10. A bingo game machine as set forth in claim 8, wherein the opening/closing cover has a slanting surface such that the discrimination balls naturally fall down therealong.

11. A bingo game machine as set forth in claim 8, wherein a front end portion of the air blast guide member attached to the air blast hole is obliquely disposed in a manner along an inner wall surface of the spherical vessel through a fixed frame.

12. A bingo game machine as set forth in claim 8, wherein a suction guide portion for circulation is interposed between the suction hole of the blower and a suction hole at the lower portion of the vessel to circulate air remaining within the vessel.

13. A bingo game machine comprising a base, a spherical vessel attached on the upper wall of the base, plural discrimination balls accommodated within the vessel, a hollow fixed shaft provided, in a longitudinal direction, at a supporting frame fixedly attached within the base, a ball flowing unit for clamping the plural discrimination balls by a drive disk and a driven disk which are rotatably provided on the fixed shaft and for releasing a clamped state of the both disks to thereby blow the discrimination balls along an inner wall of the vessel, a ball storage member fixedly disposed within the vessel so as to have an ability of detecting, through detecting means, the discrimination balls elevated by the ball blowing unit and adapted for the detected discrimination balls to drop into a ball storage portion, and a ball discharge unit in which a working rod member is provided within the hollow fixed shaft and an opening/closing cover for opening/closing the lower portion of the ball storage member at an upper end portion of the working rod member.

14. A bingo game machine as set forth in claim 13, wherein a ball supporting portion of the driven disk of the ball blowing unit is away from a ball catching annular portion of the drive disk or becomes close thereto by expanding/contracting operation of the working rod of a second drive source attached at a supporting frame.

15. A bingo game machine as set forth in claim 13, wherein a disk-shaped ball supporting portion of the driven disk of the ball blowing unit is formed so that a diameter is smaller than that of a dish-shaped ball catching annular portion of the drive disk, but is larger than that of a projected circumferential wall portion of the drive disk.

16. A bingo game machine as set forth in claim 13, wherein the drive disk of the ball blowing unit includes a dish-shaped ball catching annular portion positioned at a lowermost portion within the vessel, and a circumferential wall portion integrally provided in a projected manner on an upper surface of the ball catching annular portion.

17. A bingo game machine as set forth in claim 13, wherein synchronization pins are provided for connecting a drive disk and a driven disk of the ball blowing unit at both disks.

18. A bingo game machine as set forth in claim 13, wherein an attachment base plate having a bevel-shaped slanting surface portion adapted so that the discrimination balls which have fallen and rotates thereon is integrally provided at the upper end portion of the fixed shaft.

19. A bingo game machine as set forth in claim 13, wherein the ball storage member is disposed at a position ranging from a central portion of the vessel to a portion close to the central portion thereof through an attachment base plate fixed at the upper end portion of the fixed shaft and a supporting member fixed at the attachment base plate.

20. A bingo game machine as set forth in claim 13, wherein the ball storage member is disposed at a position ranging from the central portion of the vessel to a portion close to the central portion thereof through a supporting member having a pipe support of which one end portion of the pipe support is fixed to the vessel itself.

21. A bingo game machine as set forth in claim 13, wherein the opening/closing clover of the ball discharge unit has a slanting surface such that the discrimination balls naturally fall down therealong.

22. A bingo game machine as set forth in claim 13, wherein the working rod member of the ball discharge unit is provided within a pipe-shaped fixed shaft.

* * * * *